US006308150B1

(12) United States Patent
Neo et al.

(10) Patent No.: US 6,308,150 B1
(45) Date of Patent: Oct. 23, 2001

(54) DYNAMIC BIT ALLOCATION APPARATUS AND METHOD FOR AUDIO CODING

(75) Inventors: Sua Hong Neo; Sheng Mei Shen; Ah Peng Tan, all of Singapore (SG)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/321,742

(22) Filed: May 28, 1999

(30) Foreign Application Priority Data

Jun. 16, 1998 (JP) ..... 10-168265

(51) Int. Cl.[7] ..... G10L 19/00; G10L 21/00
(52) U.S. Cl. ..... 704/200.1; 704/229; 704/501
(58) Field of Search ..... 704/200.1, 229, 704/500, 501, 503, 504

(56) References Cited

U.S. PATENT DOCUMENTS

| | | | | |
|---|---|---|---|---|
| 5,649,053 | * | 7/1997 | Kim | 704/229 |
| 5,673,289 | * | 9/1997 | Kim et al. | 704/229 |
| 5,684,922 | * | 11/1997 | Miyakawa et al. | 704/229 |
| 5,721,806 | * | 2/1998 | Lee | 704/229 |
| 5,758,315 | * | 5/1998 | Mori | 704/229 |
| 5,761,636 | * | 7/1998 | Bolton et al. | 704/229 |
| 6,009,399 | * | 12/1999 | Spille | 704/229 |
| 6,041,295 | * | 3/2000 | Hinderks | 704/206 |
| 6,104,996 | * | 8/2000 | Yin | 704/500 |
| 6,108,625 | * | 8/2000 | Kim | 704/229 |
| 6,161,088 | * | 12/2000 | Li et al. | 704/229 |
| 6,185,539 | * | 2/2001 | Kunz et al. | 704/500 |

OTHER PUBLICATIONS

Tan et al., "Real–time implementation of a high fidelity MDCT–based codec," Singapore ICCS '94. Conference Proceedings. vol. 3, Nov. 1994, pp. 1108–1111.*

Bochow et al., "Multiprocessor implementation of an ATC audio codec," 1989 International Conference on Acoustics, Speech, and Signal Processing, vol. 3, May 1989, pp. 1981 to 1984.*

Zwicker, E., and Fstl, H., "Psychoacoustics, Facts and Models," Table of Contents, and pp. 1,14–19, and 140–155, 1990.

Sony Corp., "MiniDisc System", Rainbow Book, System Description, Table of Contents and Chapter 10, Sep. 1992.

* cited by examiner

*Primary Examiner*—William Korzuch
*Assistant Examiner*—Martin Lerner
(74) *Attorney, Agent, or Firm*—Greenblum & Bernstein, P.L.C.

(57) ABSTRACT

Provided is a dynamic bit allocation apparatus and method for audio coding which can be used widely for almost all digital audio compression systems and besides implemented simply with low cost. The bit allocation apparatus and method perform a very efficient bit allocation process, paying attention to a psychoacoustics behavior of the human audio characteristics with a simplified simultaneous masking model. In this process, peak energies of units in frequency divisional bands are computed, and a masking effect that is a minimum audio limit with the use of a simplified simultaneous masking effect model is computed and set as an absolute threshold for each unit. Then, a signal-to-mask ratio of each unit is computed, and then, based on this, an efficient dynamic bit allocation is performed.

20 Claims, 21 Drawing Sheets

PREFERRED EMBODIMENT

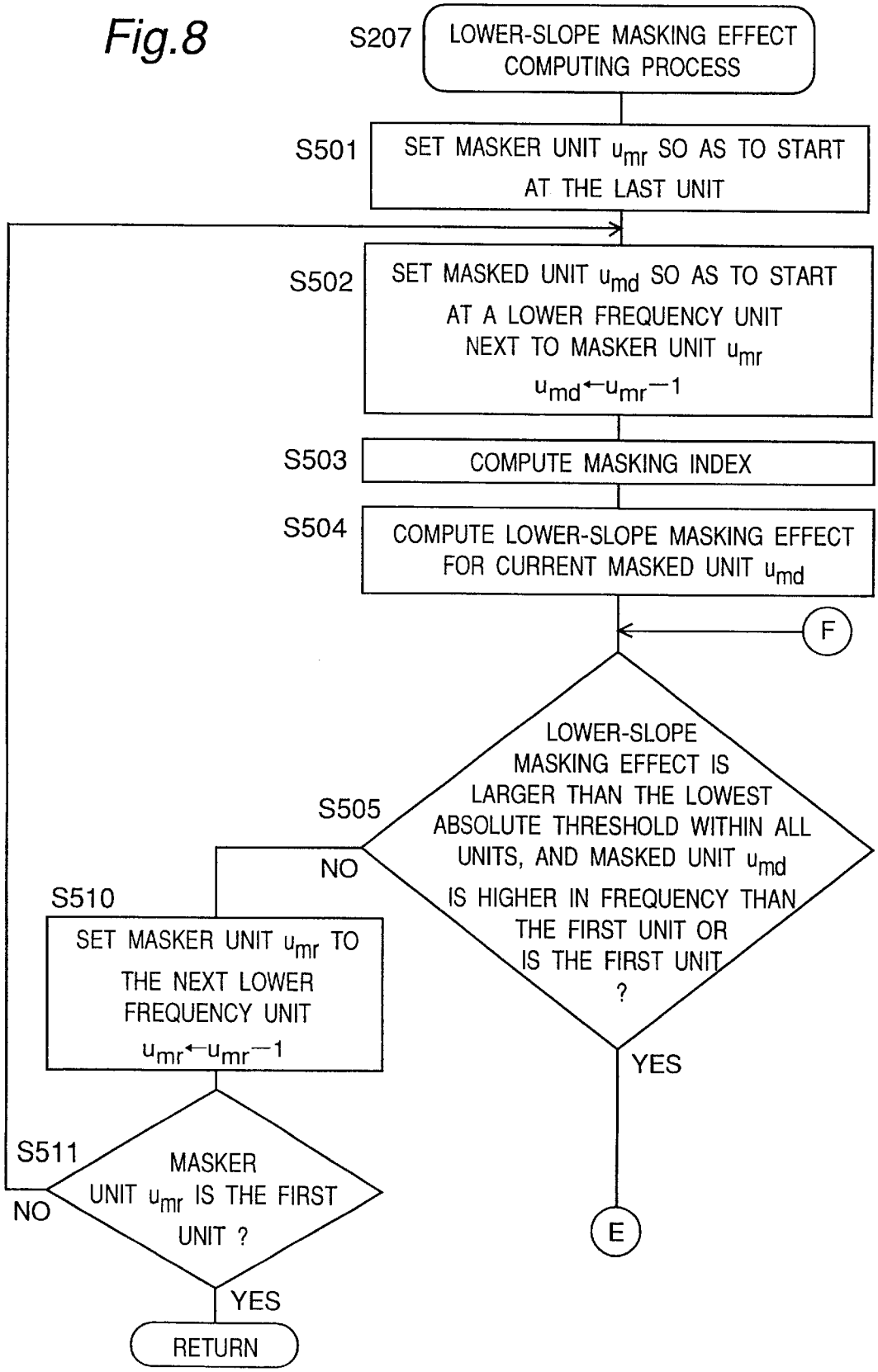
Fig.8
S207
LOWER-SLOPE MASKING EFFECT COMPUTING PROCESS
S501
SET MASKER UNIT $u_{mr}$ SO AS TO START AT THE LAST UNIT
S502
SET MASKED UNIT $u_{md}$ SO AS TO START AT A LOWER FREQUENCY UNIT NEXT TO MASKER UNIT $u_{mr}$
$u_{md} \leftarrow u_{mr} - 1$
S503
COMPUTE MASKING INDEX
S504
COMPUTE LOWER-SLOPE MASKING EFFECT FOR CURRENT MASKED UNIT $u_{md}$
F
S505
LOWER-SLOPE MASKING EFFECT IS LARGER THAN THE LOWEST ABSOLUTE THRESHOLD WITHIN ALL UNITS, AND MASKED UNIT $u_{md}$ IS HIGHER IN FREQUENCY THAN THE FIRST UNIT OR IS THE FIRST UNIT ?
NO
YES
S510
SET MASKER UNIT $u_{mr}$ TO THE NEXT LOWER FREQUENCY UNIT
$u_{mr} \leftarrow u_{mr} - 1$
S511
MASKER UNIT $u_{mr}$ IS THE FIRST UNIT ?
NO
YES
RETURN
E

LOWER-SLOPE MASKING EFFECT

DYNAMIC BIT ALLOCATION APPARATUS AND METHOD FOR AUDIO CODING

FIELD OF THE INVENTION

The present invention relates to a dynamic bit allocation apparatus and method for audio coding, and in particular, to a dynamic bit allocation apparatus and method for audio coding for encoding digital audio signals so as to generate efficient information data in order to transmit digital audio signals via a digital transmission line or to store digital audio signals in a digital storage media or recording media.

DESCRIPTION OF THE PRIOR ART

Following the recent advent of digital audio compression algorithms, some of those algorithms have been applied in consumer applications. A typical example is the ATRAC algorithm used in Mini-Disc products. This algorithm is described in Chapter 10 of the Mini-Disc system description Rainbow Book by Sony in September 1992. The ATRAC algorithm belongs to a class of hybrid coding scheme that uses both subband and transform coding.

FIG. 21 is a block diagram showing a configuration of an ATRAC encoder 100*a* equipped with a dynamic bit allocation module 109*a* for performing dynamic bit allocation process according to the prior art.

Referring to FIG. 21, an incoming analog audio signal is, first of all, converted from analog to digital form by an A/D converter 112 with a specified sampling frequency so as to be segmented into frames each having 512 audio samples (audio sample data). Each frame of the audio samples is then inputted to a QMF analysis filter module 111 which performs two-level QMF analysis filtering. The QMF analysis filter module 111 comprises a QMF filter 101, a delayer 102 and a QMF filter 103. The QMF filter 101 splits an audio signal having 512 audio samples into two subband (high band and middle/low band) signals each having an equal number (256) of audio samples, and the middle/low subband signal is further split by the QMF filter 103 into two subband (middle band and low band) signals having another equal number (128) of audio samples. The high subband signal is delayed by a delayer 102 by a time required for the process of the QMF filter 103, so that the high subband signal is synchronized with the middle subband signal and the low subband signal in the subband signals of individual frequency bands outputted from the QMF analysis filter module 111.

Subsequently, a block size determination module 104 determines individual block size modes of MDCT (Modified Discrete Cosine Transform) modules 105, 106 and 107 to be used for the three subband signals, respectively. The block size mode is fixed at either long block having a specified longer time interval or short block having a specified shorter time interval. When an attack signal having an abruptly high level of spectral amplitude value is detected, the short block mode is selected. All the MDCT spectral lines are grouped into 52 frequency division bands. Hereinafter, frequency division bands will be referred to as units. The grouping is done so that each of lower frequency units has smaller number of spectral lines compared to that of each of higher frequency units.

This grouping of units is performed based on a critical band. The term "critical band" or "critical bandwidth" refers to a band which is nonuniform on the frequency axis used in the processing of noise by the human auditory sense, where the critical-band width broadens with increasing frequency, for example, the frequency width is 100 Hz for 150 Hz, 160 Hz for 1 kHz, 700 Hz for 4 kHz, and 2.5 kHz for 10.5 kHz.

A scale factor SF[n] showing a level of each unit is computed in a scale factor module 108 by selecting in a specified table the smallest value from among values that are larger than the maximum amplitude spectral line in the unit. In a dynamic bit allocation module 109*a*, a word length WL[n], which is the number of bits allocated to quantize each spectral sample of a unit, is determined. Finally, the spectral samples of the units are quantized in a quantization module 110 with the use of side information comprising scale factor SF[n] and word length WL[n] of bit allocation data, and then audio spectral data ASD[n] is outputted.

The dynamic bit allocation module 109*a* plays an important role in determining the sound quality of the coded audio signal as well as the implementation complexity. Some of the existing methods make use of the variance of spectral level of the unit to perform the bit allocation. In the bit allocation process, the unit with the highest variance is, first of all, searched, and then, one bit is allocated to the unit. The variance of spectral level of this unit is then reduced by a certain factor. This process is repeated until all the bits available for bit allocation are exhausted. This method is highly iterative and consumes a lot of computational power. Moreover, the lack of use of psychoacoustic masking phenomenon makes it difficult for this method to achieve good sound quality. Other methods such as the ones used in the ISO/IEC 11172-3 MPEG Audio Standard use a very complicated psychoacoustic model and also an iterative bit allocation process.

It is well known to those skilled in the art that established digital audio compression systems such as MPEG1 Audio Standards make use of a psychoacoustics model of the human auditory system to estimate an absolute threshold of masking effect, by which quantization noise is made inaudible when the quantization noise is kept below the absolute threshold. Although two psychoacoustics models proposed by MPEG1 Audio Standards do achieve a good sound quality, those models are far too complicated to implement in low-cost LSIs for. consumer applications. This gives rise to a need of simplified masking threshold computation.

SUMMARY OF THE INVENTION

An essential object of the present invention is therefore to provide a dynamic bit allocation apparatus for audio coding which can be used widely for almost all digital audio compression systems and besides implemented simply with low cost.

Another object of the present invention is therefore to provide a dynamic bit allocation method for audio coding which can be used widely for almost all digital audio compression systems and besides implemented simply with low cost.

In order to achieve the aforementioned objective, according to the present invention, there is provided a dynamic bit allocation apparatus or method for audio coding for determining a number of bits used to quantize a plurality of decomposed samples of a digital audio signal, the plurality of samples being grouped into a plurality of units each having at least either one of different frequency intervals or time intervals, the different frequency intervals being determined based on a critical band of human audio characteristics and the different time intervals including a first time interval and a second time interval longer than the first time interval. The apparatus and method of the present invention includes the following steps of:

(a) an absolute threshold setting step for setting an absolute threshold for every unit based on a specified threshold characteristic in quiet representing whether or not a person is audible in quiet;

(b) an absolute threshold adjusting step for adjusting the absolute threshold of a unit having the first time interval by replacing the absolute threshold of the unit having the first time interval by a minimum absolute threshold among a plurality of units having the same frequency interval;

(c) a peak energy computing step for computing peak energies of the units based on the plurality of samples grouped into the plurality of units;

(d) a masking effect computing step for computing a masking effect that is a minimum audible limit with the simplified simultaneous masking effect model based on a specified simplified simultaneous masking effect model and a peak energy of a masked unit when all the units have the second time interval, and updating and setting the absolute threshold of each unit with the computed masking effect;

(e) a signal-to-maskratio (SMR) computation step for computing SMRs of the units based on the computed peak energy of each unit and the computed absolute threshold of each unit;

(f) a number-of-available-bits computing step for computing a number of bits available for bit allocation based on a frame size of the digital audio signal, assuming that all frequency bands to be quantized include all the units;

(g) an SMR positive-conversion step for positively converting the SMRs of all the units by adding a specified positive number to the SMRs of all the SMRs so as to make the SMRs all positive;

(h) an SMR-offset computing step for computing an SMR-offset which is defined as an offset for reducing the positively converted SMRs of all the units, based on the positively converted SMRs of all the units, a SMR reduction step determined based on an improvement in signal-to-noise ratio per bit of a specified linear quantizer, and the number of available bits;

(i) a bandwidth computing step for updating a bandwidth which covers units that need to be allocated bits based on the computed SMR-offset and the computed SMRs of the units so as to update the SMR-offset based on the computed bandwidth;

(j) a sample bit computing step for computing a subtracted SMR by subtracting the computed SMR-offset from the computed SMR in each unit, and then, computing a number of sample bits representing a number of bits to be allocated to each unit in quantization based on the subtracted SMR of each unit and the SMR reduction step; and (k) a remaining bit allocation step for allocating a number of remaining bits resulting from subtracting a sum of the numbers of sample bits to be allocated to all the units from the computed number of available bits to at least units having an SMR larger than the SMR-offset.

In the above-mentioned apparatus and method, in said peak energy computing step, the peak energy of each unit is preferably computed by executing a specified approximation in which an amplitude of the largest spectral coefficient within each unit is replaced by a scale factor corresponding to the amplitude with use of a specified scale factor table.

In the above-mentioned apparatus and method, in said masking effect computing step, the specified simplified simultaneous masking effect model preferably includes a high-band side masking effect model to be used to mask an audio signal of units higher in frequency than the masked units, and a low-band side masking effect model lower in frequency than the masked units, and wherein an absolute threshold finally determined for each of the masked units preferably is set to a maximum value out of the set absolute thresholds of the masked units and the simultaneous masking effect determined by said simultaneous masking effect model.

In the above-mentioned apparatus and method, in said SMR computing step, the SMR of each unit is preferably computed by subtracting the set absolute threshold from the peak energy of the unit in decibel (dB).

In the above-mentioned apparatus and method, in said SMR-offset computing step, the SMR-offset is preferably computed by computing an initial SMR-offset based on the integer-truncated SMRs of all the units, the SMR reduction step and the number of bits available for the bit allocation, and then, performing a specified iterative process based on the computed initial SMR-offset.

In the above-mentioned apparatus and method, said iterative process preferably includes the following steps of:

removing units having an SMR smaller than the initial SMR-offset from the computation of the SMR-offset; and iteratively re-computing the SMR-offset based on the integer-truncated SMRs of the remaining units, the SMR reduction step and the number of available bits available for the bit allocation until SMRs of all the units involved in the SMR-offset computation become larger than the finally determined SMR-offset, thereby ensuring that there occurs no allocation of any negative bit number.

In the above-mentioned apparatus and method, in said bandwidth computing step, the bandwidth is preferably computed by removing consecutive units from specified units when units having an SMR smaller than the SMR-offset are consecutively present, and wherein the number of bits corresponding to the removed units is preferably added to the number of available bits so as to update the number of available bits, said updating of the SMR-offset is executed based on the updated number of available bits.

In the above-mentioned apparatus and method, in said sample bit computing step, the number of sample bits of each unit is preferably a value which is obtained by subtracting the SMR-offset from the SMR of each unit, dividing the subtraction result by the SMR reduction step, and then, integer-truncating the division result; and wherein the bit allocation for units having an SMR smaller than the SMR-offset is suppressed.

In the above-mentioned apparatus and method, in said remaining bit allocation step, specified first and second pass processes for allocating the number of remaining bits are preferably executed;

in the first pass process, one bit is allocated to units each of which has an SMR larger than the SMR-offset but to each of which no bits have been allocated as a result of integer-truncation in said sample bit computing step; and in the second pass process, one bit is allocated to units to each of which a number of bits that is not the maximum number of bits but a plural number of bits have been allocated.

In the above-mentioned apparatus and method, in said remaining bit allocation step, the first and second pass processes are preferably executed while the unit is transited from the highest frequency unit to the lowest frequency unit.

Accordingly, the present invention can be applied to almost all digital audio compression systems. In particular, when used in the ATRAC algorithm, a speech having remarkably high audio quality can be generated while the bit allocation can be accomplished dynamically, remarkably effectively and efficiently. Further, the present bit allocation process has a relatively low implementation complexity as compared with that of the prior art, and low-cost LSI implementation of an audio encoder can be accomplished by using the improved ATRAC encoder of the present invention.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 8 is a flow chart showing a first portion of a lower-slope masking effect computing process (step S207) which is a subroutine of FIG. 2;

DETAILED DESCRIPTION OF THE PREFERRED EMBODIMENTS

Preferred embodiments according to the present invention will be described below with reference to the accompanying drawings.

Figure 1:
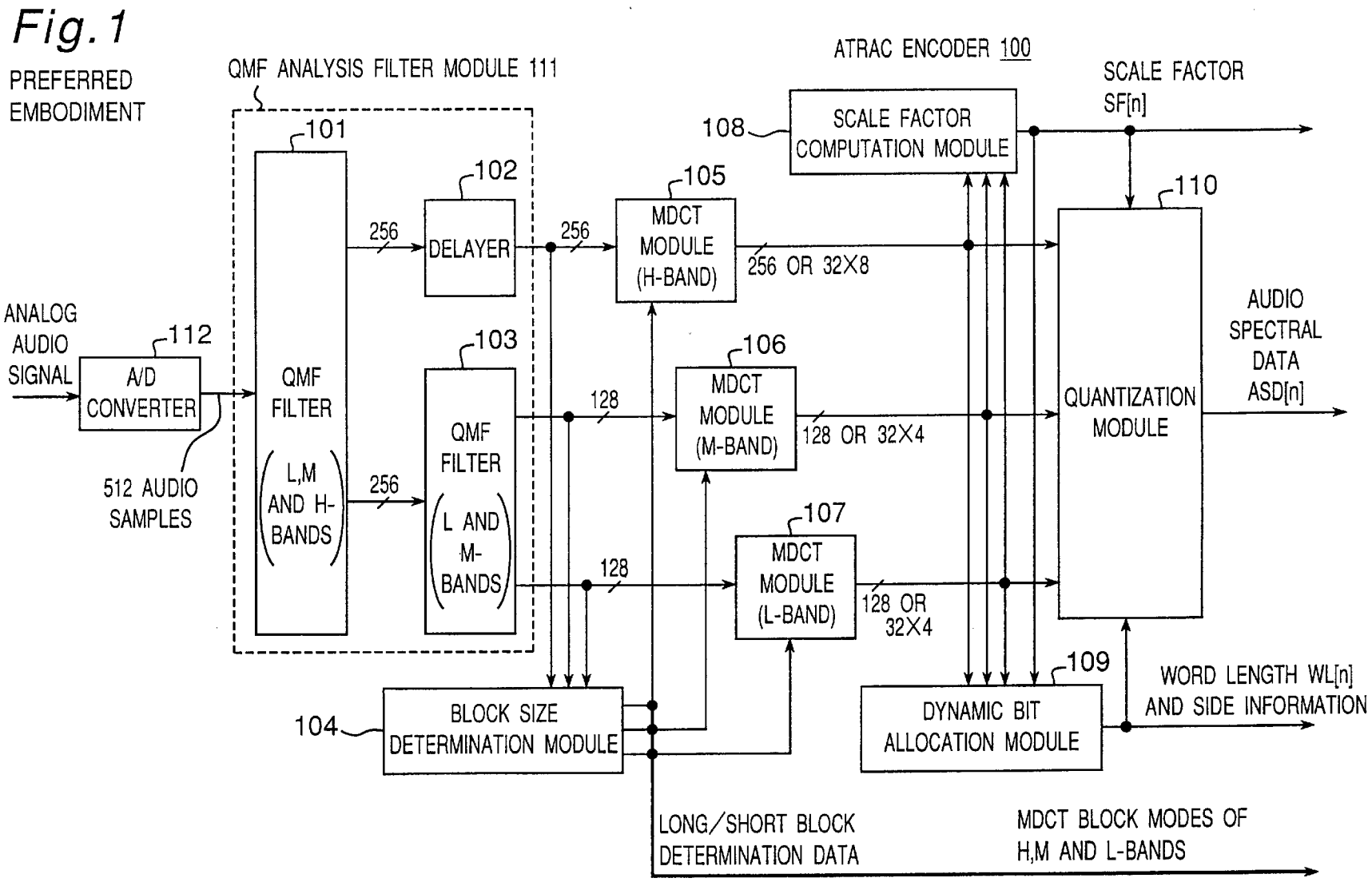
FIG. 1 is a block diagram showing a configuration of the ATRAC encoder 100 equipped with the dynamic bit allocation module 109 for performing a dynamic bit allocation process in a preferred embodiment according to the present invention.
Figure 21:
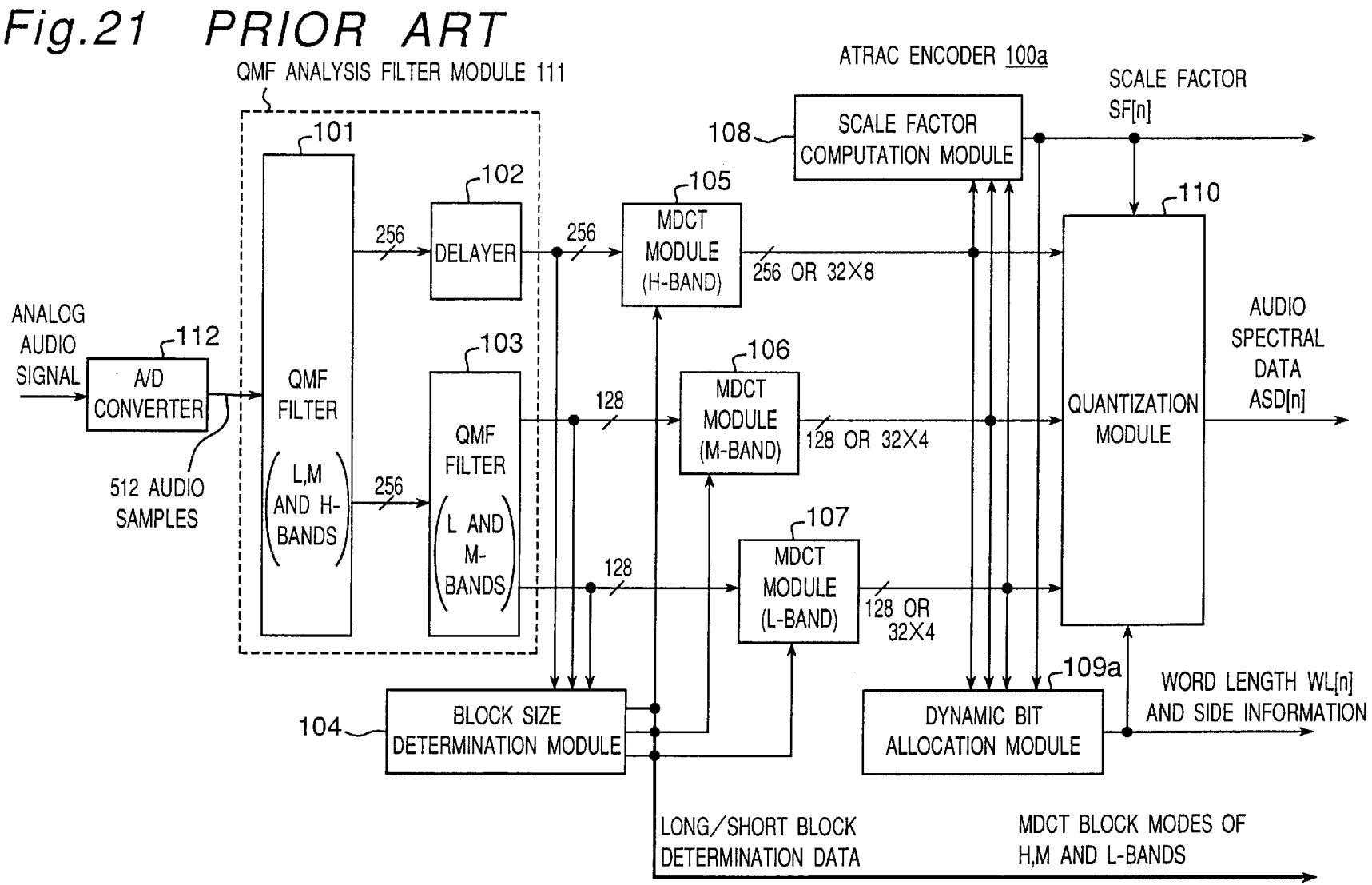
Fig.21 PRIOR ART
FIG. 21 is a block diagram showing a configuration of an ATRAC encoder 100*a* equipped with a dynamic bit allocation module 109*a* for performing a dynamic bit allocation process according to the prior art.

FIG. 1 is a block diagram of an ATRAC encoder 100 equipped with a dynamic bit allocation module 109 for performing dynamic bit allocation process of a preferred embodiment according to the present invention. The present preferred embodiment is characterized in that the dynamic bit allocation module 109*a* of the ATRAC encoder 100*a* of the prior art shown in FIG. 21 is replaced with the dynamic bit allocation module 109 whose dynamic bit allocation process is different from that of the dynamic bit allocation module 109*a*.

Although the dynamic bit allocation process of the present preferred embodiment will be described below by using the ATRAC algorithm as an example of preferred embodiments, the present preferred embodiment may be also applied to other audio coding algorithms.

The present preferred embodiment according to the present invention includes the following steps of:

(a) a process of computing the peak energies of all units by using scale factor indices;

(b) a process of adjusting the absolute threshold when the short block MDCT is used;

(c) a process of computing the upper-slope masking effect and the lower-slope masking effect with the peak energies of the units;

(d) a process of computing the signal-to-mask ratios (hereinafter referred to as SMRs) of all the units;

(e) a process of adding a dummy off-set to all the SMRs so that the SMRs become positive;

(f) a process of computing an SMR-offset;

(g) a process of computing the bandwidth;

(h) a process of computing the number of sample bits allocated to each unit based on the SMR and the SMR-offset of the unit; and (i) a process of allocating the remaining bits out of the number of available bits to several selected units.

Concretely speaking, in the dynamic bit allocation apparatus and method of the present preferred embodiment for audio coding for determining a number of bits used to quantize a plurality of decomposed samples of a digital audio signal, the plurality of samples are grouped into a plurality of units each having at least either one of different frequency intervals or time intervals, the different frequency intervals being determined based on a critical band of human audio characteristics and the different time intervals including a first time interval and a second time interval longer than the first time interval. The apparatus and method includes the following steps of:

(a) an absolute threshold setting step for setting an absolute threshold for every unit based on a specified threshold characteristic in quiet representing whether or not a person is audible in quiet;

(b) an absolute threshold adjusting step for adjusting the absolute threshold of a unit having the first time interval by replacing the absolute threshold of the unit having the first time interval by a minimum absolute threshold among a plurality of units having the same frequency interval;

(c) a peak energy computing step for computing peak energies of the units based on the plurality of samples grouped into the plurality of units;

(d) a masking effect computing step for computing a masking effect that is a minimum audible limit with the simplified simultaneous masking effect model based on a specified simplified simultaneous masking effect model and a peak energy of a masked unit when all the units have the second time interval, and updating and setting the absolute threshold of each unit with the computed masking effect;

(e) a signal-to-mask ratio (SMR) computation step for computing SMRs of the units based on the computed peak energy of each unit and the computed absolute threshold of each unit;

(f) a number-of-available-bits computing step for computing a number of bits available for bit allocation based on a frame size of the digital audio signal, assuming that all frequency bands to be quantized include all the units;

(g) an SMR positive-conversion step for positively converting the SMRs of all the units by adding a specified positive number to the SMRs of all the SMRs so as to make the SMRs all positive;

(h) an SMR-offset computing step for computing an SMR-offset which is defined as an offset for reducing the positively converted SMRs of all the units, based on the positively converted SMRs of all the units, a SMR reduction step determined based on an improvement in signal-to-noise ratio per bit of a specified linear quantizer, and the number of available bits;

(i) a bandwidth computing step for updating a bandwidth which covers units that need to be allocated bits based on the computed SMR-offset and the computed SMRs of the units so as to update the SMR-offset based on the computed bandwidth;

(j) a sample bit computing step for computing a subtracted SMR by subtracting the computed SMR-offset from the computed SMR in each unit, and then, computing a number of sample bits representing a number of bits to be allocated to each unit in quantization based on the subtracted SMR of each unit and the SMR reduction step; and (k) a remaining bit allocation step for allocating a number of remaining bits resulting from subtracting a sum of the numbers of sample bits to be allocated to all the units from the computed number of available bits to at least units having an SMR larger than the SMR-offset.

Peak energies of all the units are determined from their maximum spectral sample data. This can be approximated by using their corresponding scale factor indices and so the use of logarithmic operation can be avoided. The peak energies are then used in estimating the simplified simultaneous masking absolute threshold as well as for computing the signal-to-mask ratio (SMR). The function of the simultaneous masking model is approximated by an upper slope and a lower slope. It is noted here that with respect to a masking curve modeled for the spectral signal of a frequency, a masking curve of a frequency region higher than the frequency of the spectral signal is referred to as an upper slope, and a masking curve of a frequency region lower than the frequency of the spectral signal is referred to as a lower slope. The gradient of the upper-slope masking effect is assumed to be −10 dB/Bark and that of the lower slope is 27 dB/Bark. It is also assumed that every unit has one masker audio signal (hereinafter, referred to also as a masker) whose sound compression level is represented by the peak energy of the unit without consideration of its auditory characteristics. The masking effect exerted by a unit having a masker audio signal (hereinafter, referred to as a masker unit) as well as a unit having other audio signals masked by the masker unit (hereinafter, referred to as a masked unit) is computed from the worst-case distance expressed in critical bandwidth (Bark) between the maximum absolute threshold within the masker unit and the maximum absolute threshold of the masked unit, together with the gradient of the lower slope or the gradient of the upper slope depending on whether the masked unit is located in the lower or higher frequency region than the masker audio signal, respectively.

The simultaneous masking effect is applied only when all the three subbands of a particular frame are transformed by MDCT of the long block mode. The masking absolute threshold of a given unit is selected from the highest among the absolute threshold, the low-band masking absolute threshold and the high-band masking absolute threshold computed on the unit. In the case when some or all subbands are transformed into a plurality of spectral lines by using the short block MDCT, only the adjusted absolute threshold is used. The adjustment of the absolute threshold is required due to a change in time and frequency resolutions. For example, if a long block MDCT is replaced by four equal-length short block MDCT, the frequency interval spanned by four long block units is now covered by each of the four short block units. Thus, the minimum absolute threshold selected from the four long block units is used to represent the adjusted absolute threshold of the four short block units.

The bit allocation procedure employs an SMR-offset to speed up the allocation of sample bits. Before being used in SMR-offset computation, the original SMRs of all units are raised above zero value by adding a dummy positive number to them. With these raised SMRs and other parameters such as the number of spectral lines within a given unit and the number of available bits, the SMR-offset can be computed. The bandwidth is then determined from the SMRs and SMR-offset. Only those units with an SMR larger than the SMR-offset are allocated bits. The value of sample bits representing the number of bits allocated to a unit is computed by dividing the difference between SMR and SMR-offset by an SMR reduction factor (or SMR reduction step amount). This SMR reduction factor is closely related to the improved value of signal-to-noise ratio (SNR) in dB of a linear quantizer with each increment of one quantization bit and is taken to be 6.02 dB. An integer-truncation operation is applied to the computed sample bits and also the sample bits are subjected to a maximum limit of 16 bits. As such, even if some bits are allocated to some units, some remaining bits are left over. Those remaining bits are allocated back to units having SMR larger than SMR-offset in two passes. The first pass allocates 2 bits to units with zero bit allocation. The second pass allocates one bit to units in which bit allocation lies between two and fifteen bits. In this way, bit allocation is carried out on a plurality of units.

Thus, the present preferred embodiment is characterized in that the masking effect computation that requires complex computations in the dynamic bit allocation process of the prior art is simply accomplished by using simplified simultaneous masking effect models. As a result, an efficient dynamic bit allocation process with high sound quality and less computations can be achieved.

Referring to FIG. 1, processing blocks except the dynamic bit allocation module 109 operate in the same manner as the processing blocks of the prior art of FIG. 21.

Figure 2:
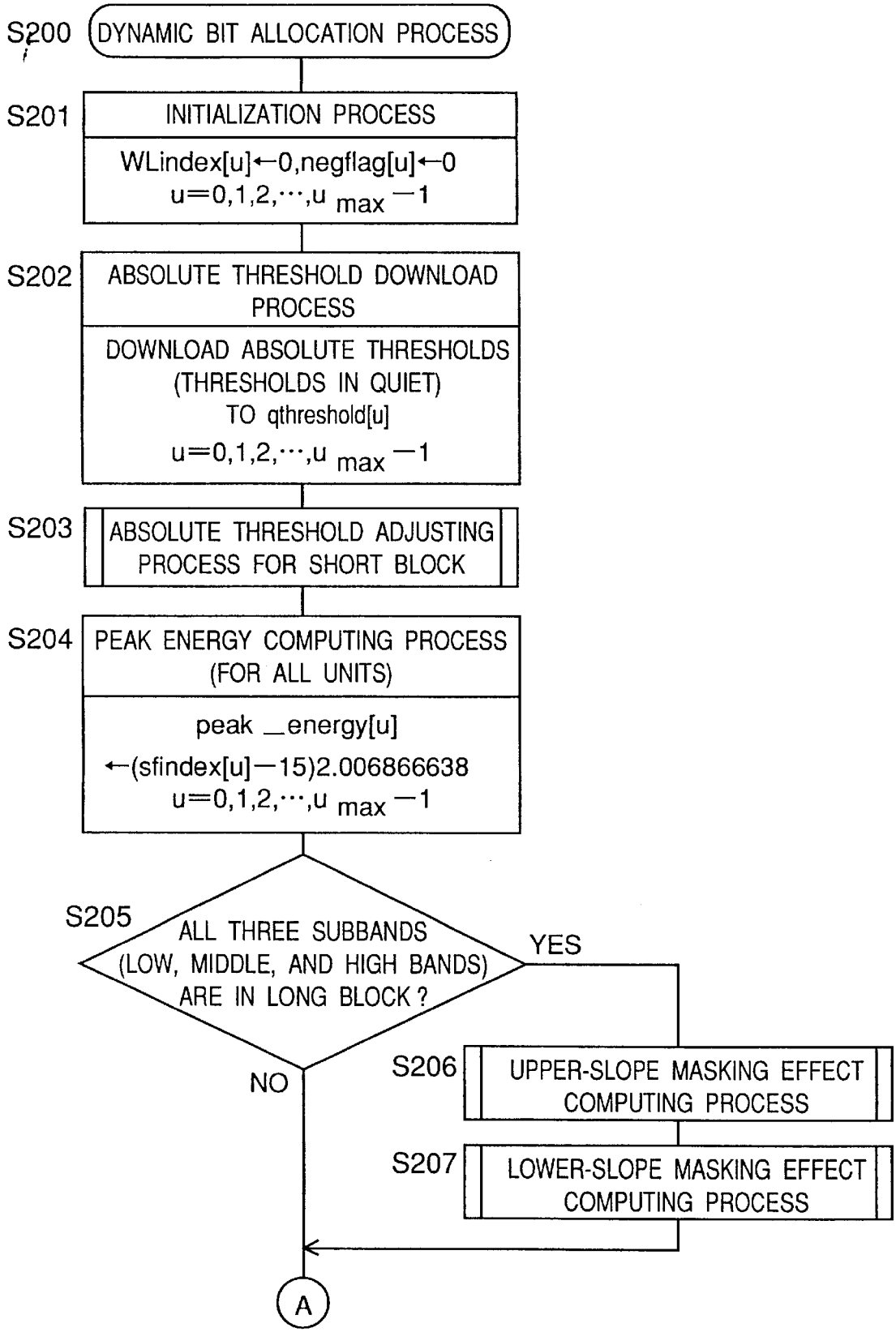
FIG. 2 is a flow chart showing a first portion of the dynamic bit allocation process to be executed by the dynamic bit allocation module 109 of FIG. 1.
Figure 3:
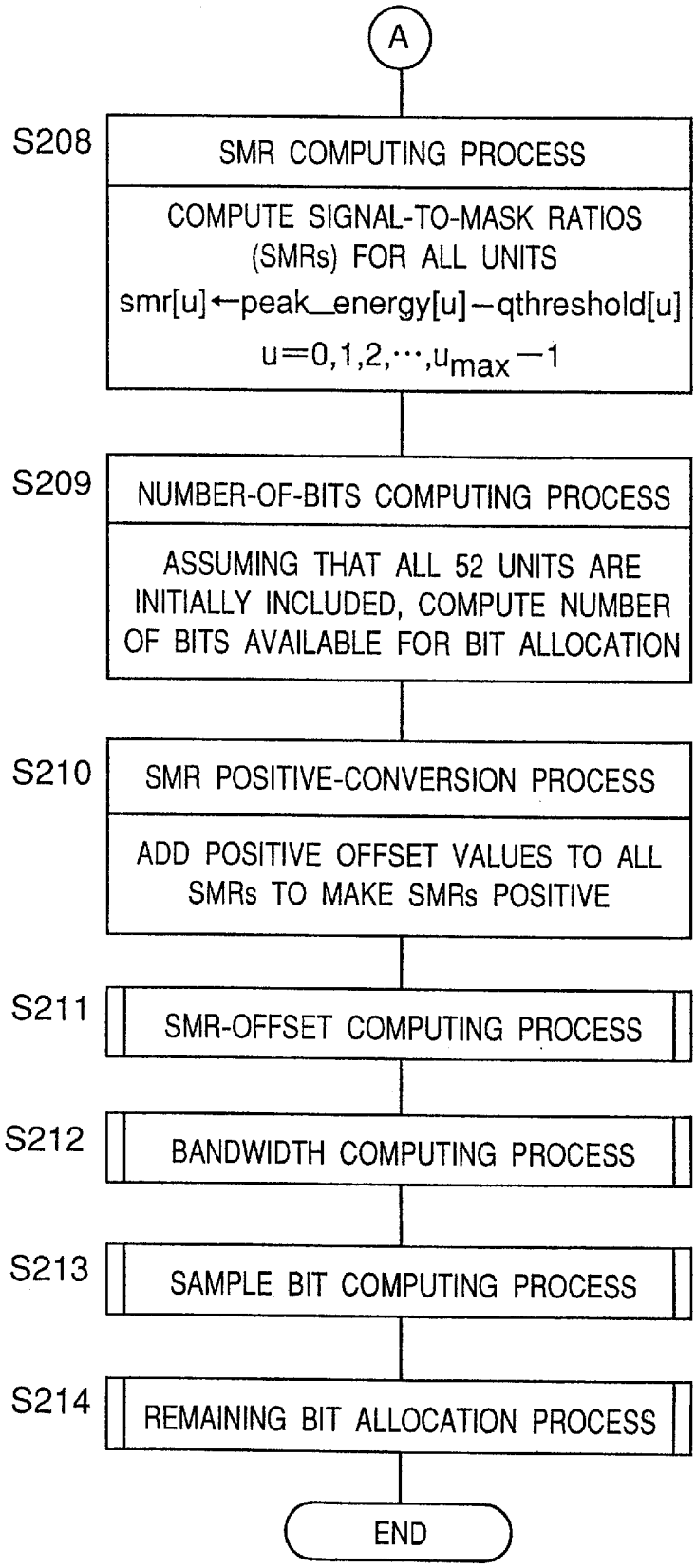
FIG. 3 is a flow chart showing a second portion of the dynamic bit allocation process to be executed by the dynamic bit allocation module 109 of FIG. 1.

FIGS. 2 and 3 are flow charts showing a dynamic bit allocation process to be executed by the dynamic bit allocation module 109 of FIG. 1.

First of all, in an initialization process of step S201 in FIG. 2, a word length index (WLindex[u]) for designating the number of bits allocated to all the units u (u=0, 1, 2, . . . , $u_{max}-1$) and a negative flag (negflag[u]) used in the bit allocation process or the like are each initialized to zero. It is noted here that preferably, $u_{max}=52$.

Next, in an absolute threshold download process of step S202, absolute thresholds of the units, also known as threshold in quiet, are downloaded to set values qthreshold[u]. According to a prior art reference, E. Zwicker et al., "Psychoacoustics: Facts andModels", Springer-Verlag, 1990, as the absolute thresholds in quiet, sound pressure level of just audible pure tones is shown as a function of frequency. In the audio standard specifications of MPEG1, the threshold in quiet is also referred to as an absolute threshold. All of the threshold in quiet, the audible threshold in quiet and the masking threshold in quiet have the same meaning.

Next, in an absolute threshold adjusting process for the short block of step S203, depending on whether the short block mode is activated, the absolute threshold of a particular frequency band is adjusted. In a peak energy computing process of step S204, peak energies (peak_energy[u]) of all the units u (u=0, 1, 2, . . . , $u_{max}-1$) are computed by the following Equation (1):

$$\begin{aligned} \text{peak_energy}[u] &= 10\times\log_{10}(\text{max_spectral_amplitude}[u])^2 \ \ [\text{dB}], \qquad (1)\\ &\approx 10\times\log_{10}(\text{scale_factor}[u])^2 \\ &= (sfindex[u]-15)\times 2.006866638 \\ &\text{where } u = 0, 1, 2, \ldots, u_{\max}-1. \end{aligned}$$

As apparent from Equation (1), the computation of peak energies (peak_energy[u]) for the units u is approximated by replacing the maximum spectral amplitudes (max_spectral_amplitude[u]) in a relevant unit u with its corresponding scale factor (scale factor [u]). The scale factor (scale factor[u]) is the smallest number selected from a scale factor table shown below that is larger than the maximum spectral amplitude (max_spectral_amplitude[u]) within the relevant unit u. In the ATRAC algorithm, the scale factor table consists of 64 scale factor values which are addressed by a 6-bit scale factor index (sfindex [u]). The scale factor tables are shown as follows.

TABLE 1

| 6-bit scale factor index sfindex [u] | Scale factor Scale factor [u] |
|---|---|
| 0 | $0.99999999\times 2^{-5}$ |
| 1 | $0.62996052\times 2^{-4}$ |
| 2 | $0.79370052\times 2^{-4}$ |
| 3 | $0.99999999\times 2^{-4}$ |
| 4 | $0.62996052\times 2^{-3}$ |
| 5 | $0.79370052\times 2^{-3}$ |
| 6 | $0.99999999\times 2^{-3}$ |
| 7 | $0.62996052\times 2^{-2}$ |
| 8 | $0.79370052\times 2^{-2}$ |
| 9 | $0.99999999\times 2^{-2}$ |
| 10 | $0.62996052\times 2^{-1}$ |
| 11 | $0.79370052\times 2^{-1}$ |
| 12 | $0.99999999\times 2^{-1}$ |
| 13 | $0.62996052\times 2^{0}$ |
| 14 | $0.79370052\times 2^{0}$ |
| 15 | $0.99999999\times 2^{0}$ |
| 16 | $0.62996052\times 2^{1}$ |
| 17 | $0.79370052\times 2^{1}$ |
| 18 | $0.99999999\times 2^{1}$ |
| 19 | $0.62996052\times 2^{2}$ |
| 20 | $0.79370052\times 2^{2}$ |
| 21 | $0.99999999\times 2^{2}$ |
| 22 | $0.62996052\times 2^{3}$ |
| 23 | $0.79370052\times 2^{3}$ |
| 24 | $0.99999999\times 2^{3}$ |
| 25 | $0.62996052\times 2^{4}$ |
| 26 | $0.79370052\times 2^{4}$ |
| 27 | $0.99999999\times 2^{4}$ |
| 28 | $0.62996052\times 2^{5}$ |
| 29 | $0.79370052\times 2^{5}$ |
| 30 | $0.99999999\times 2^{5}$ |

TABLE 2

| 6-bit scale factor index sfindex [u] | Scale factor Scale factor [u] |
|---|---|
| 31 | $0.62996052\times 2^{6}$ |
| 32 | $0.79370052\times 2^{6}$ |
| 33 | $0.99999999\times 2^{6}$ |
| 34 | $0.62996052\times 2^{7}$ |
| 35 | $0.79370052\times 2^{7}$ |
| 36 | $0.99999999\times 2^{7}$ |
| 37 | $0.62996052\times 2^{8}$ |
| 38 | $0.79370052\times 2^{8}$ |
| 39 | $0.99999999\times 2^{8}$ |
| 40 | $0.62996052\times 2^{9}$ |
| 41 | $0.79370052\times 2^{9}$ |
| 42 | $0.99999999\times 2^{9}$ |
| 43 | $0.62996052\times 2^{10}$ |
| 44 | $0.79370052\times 2^{10}$ |
| 45 | $0.99999999\times 2^{10}$ |
| 46 | $0.62996052\times 2^{11}$ |
| 47 | $0.79370052\times 2^{11}$ |
| 48 | $0.99999999\times 2^{11}$ |
| 49 | $0.62996052\times 2^{12}$ |
| 50 | $0.79370052\times 2^{12}$ |
| 51 | $0.99999999\times 2^{12}$ |
| 52 | $0.62996052\times 2^{13}$ |
| 53 | $0.79370052\times 2^{13}$ |
| 54 | $0.99999999\times 2^{13}$ |
| 55 | $0.62996052\times 2^{14}$ |
| 56 | $0.79370052\times 2^{14}$ |
| 57 | $0.99999999\times 2^{14}$ |
| 58 | $0.62996052\times 2^{15}$ |
| 59 | $0.79370052\times 2^{15}$ |
| 60 | $0.99999999\times 2^{15}$ |
| 61 | $0.62996052\times 2^{16}$ |
| 62 | $0.79370052\times 2^{16}$ |
| 63 | $0.99999999\times 2^{16}$ |

In order to get rid of the logarithmic operation for efficient implementation of the present preferred embodiment, the scale factor index (sfindex[u]) is used to simplify the computation of peak energy (peak_energy[u]). A scale factor index, 15, which gives rise to zero dB peak energy is used as a reference value. The peak energy (peak_energy[u]) is computed by subtracting the reference value 15 from the scale factor index (sfindex[u]), and by multiplying the resultant difference by a constant 2.006866638. The constant represents the average peak energy increment in decibel (dB) per scale factor index (sfindex[u]) step.

At a step S205 of FIG. 3, it is decided whether or not all the three subbands (low, middle and high bands) are coded using the long block MDCT. If YES at step S205, an upper-slope masking effect computing process is executed at step S206, and thereafter, a lower-slope masking effect computing process is executed at step S207, then the program flow goes to step S208. On the other hand, if NO at step S205, the program flow goes directly to step S208. That is, when the subbands of all the three frequency bands are encoded by using the long block data from MDCT, a simplified simultaneous masking absolute threshold can be computed at steps S206 and S207. The spreading function of the masker unit defines the degree of masking (hereinafter, referred to as a masking effect) at frequencies other than the frequency of the masker unit itself. The masking effect is approximated by an upper slope and a lower slope. In the present preferred embodiment, the upper slope and the lower slope are chosen to be −10 dB/Bark and 27 dB/Bark, respectively.

Figure 6:
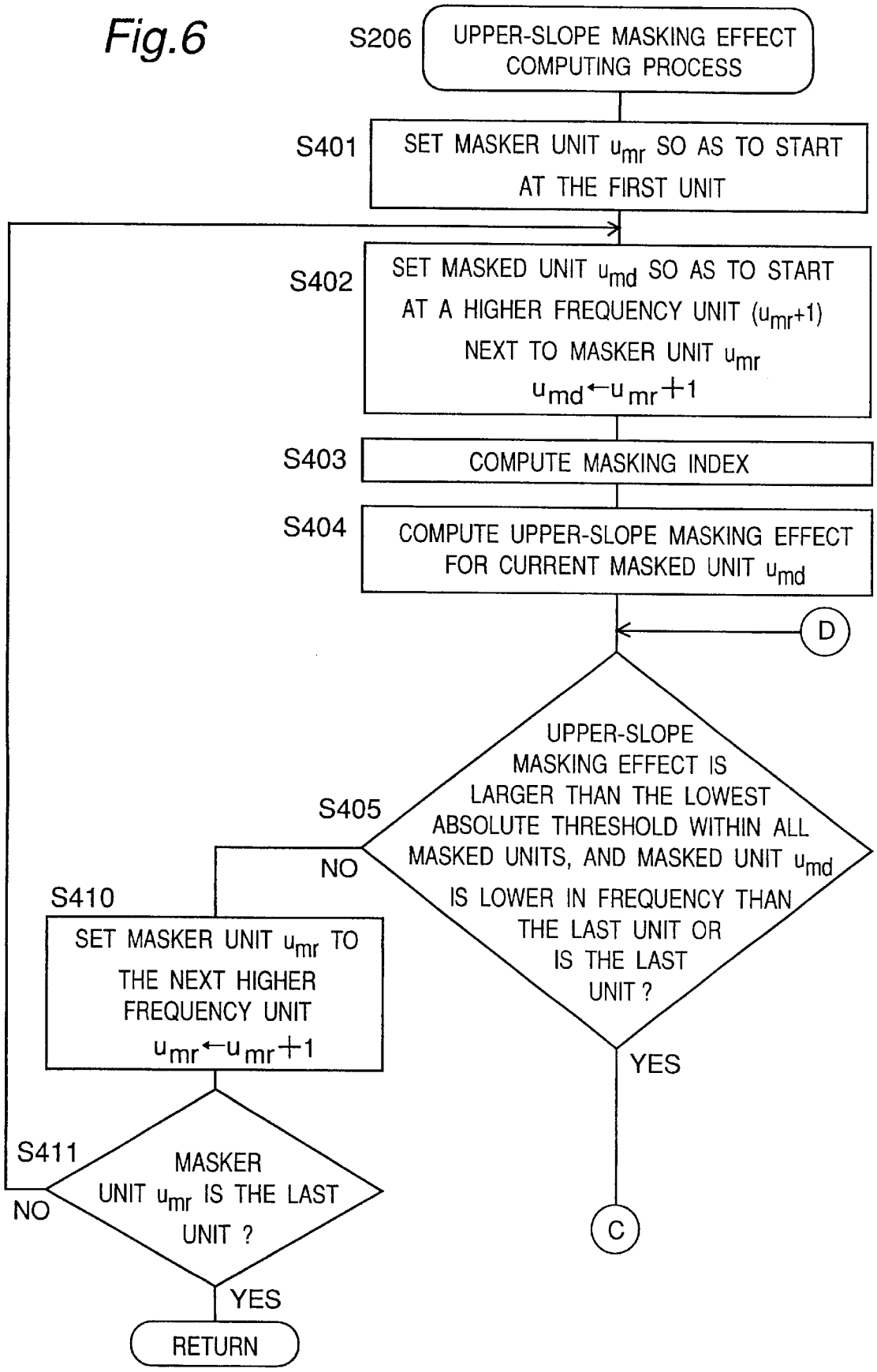
FIG. 6 is a flow chart showing a first portion of an upper-slope masking effect computing process (step S206), which is a subroutine of FIG. 2.
Figure 7:
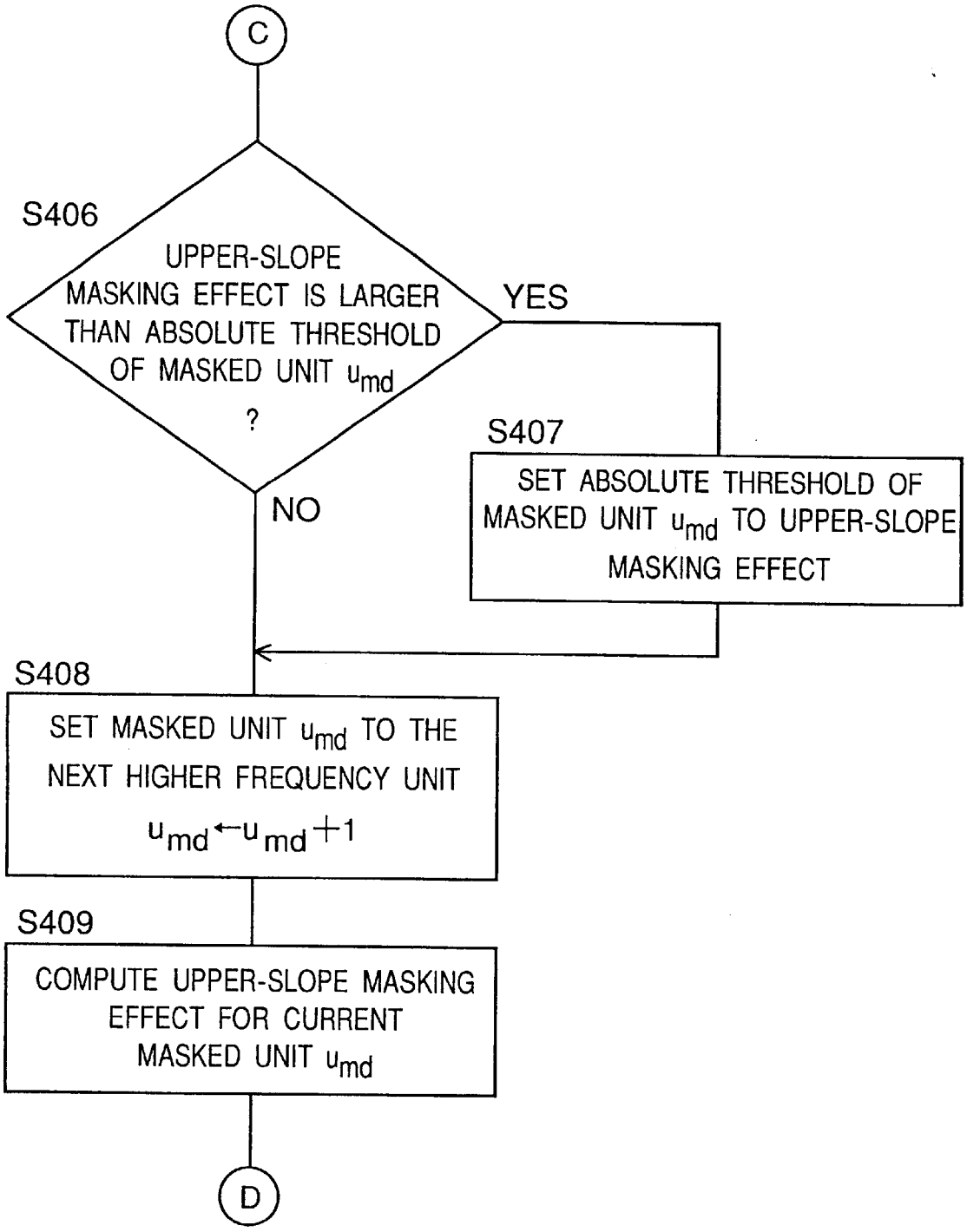
FIG. 7 is a flow chart showing a second portion of the upper-slope masking effect computing process (step S206), which is a subroutine of FIG. 2.
Figure 18:
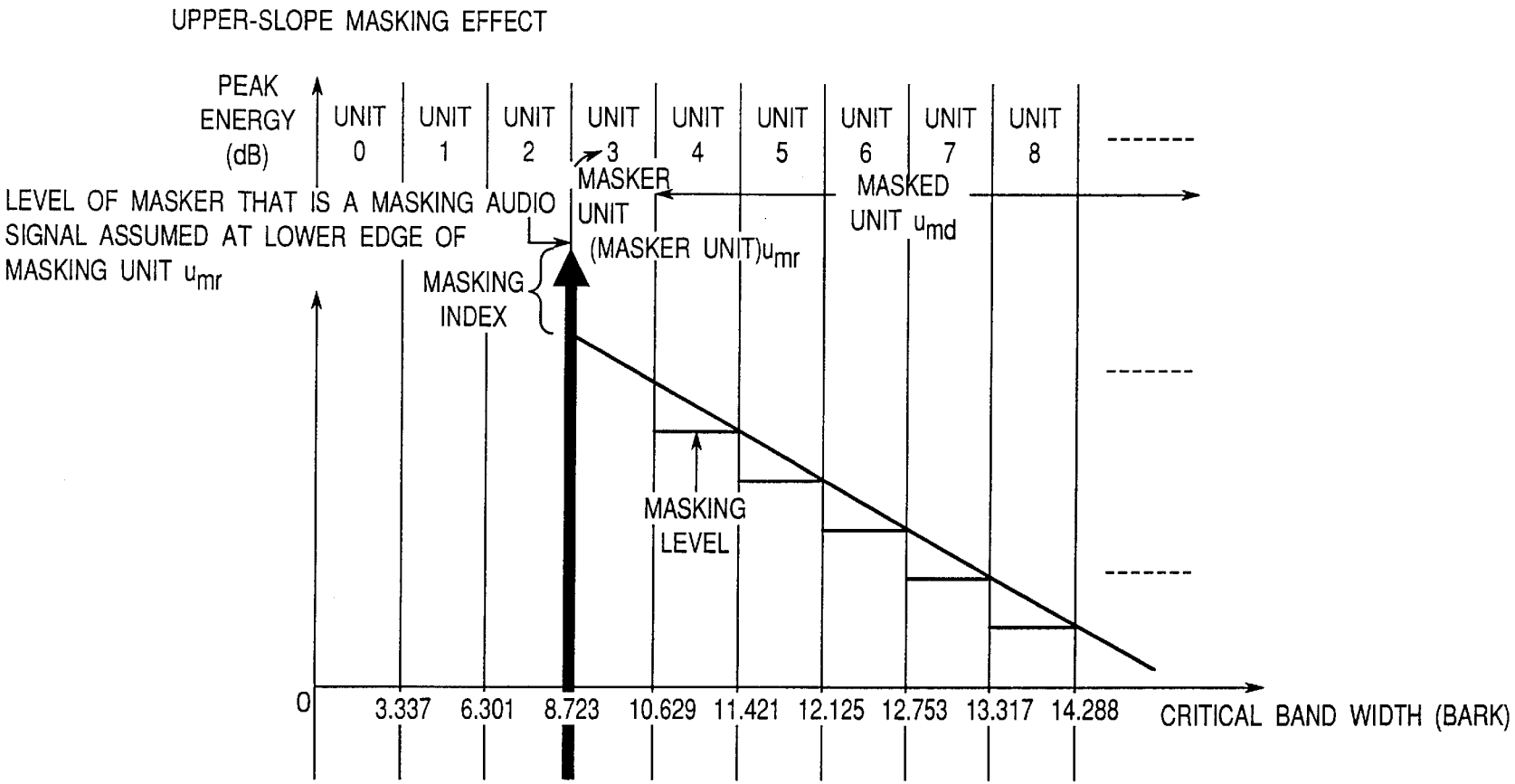
FIG. 18 is a graph showing an upper-slope masking effect computation in the masking effect computation process of FIGS. 6 and 7, the graph showing a relationship between a peak energy (dB) and a critical bandwidth (Bark)
Figure 19:
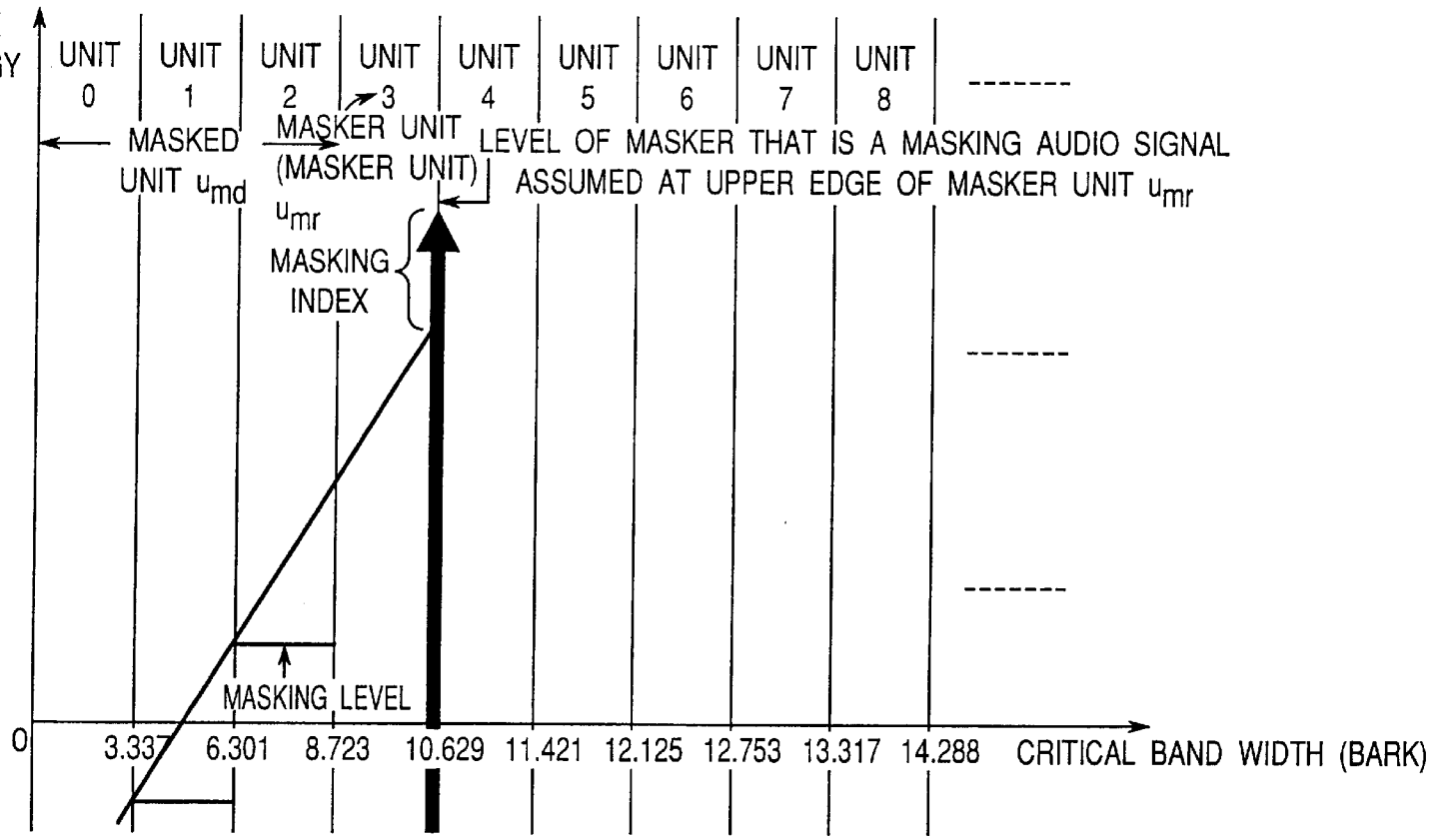
FIG. 19 is a graph showing a lower-slope masking effect computation in the masking effect computation process of FIGS. 8 and 9, the graph showing a relationship between a peak energy (dB) and a critical bandwidth (Bark)

FIG. 18 is a graph showing an upper-slope masking effect computation in the upper-slope masking effect computation process of FIGS. 6 and 7, the graph showing a relationship between a peak energy (dB) and a critical bandwidth (Bark). FIG. 19 is a graph showing a lower-slope masking effect computation in the lower-slope masking effect computation process of FIGS. 8 and 9, the graph showing a relationship between a peak energy (dB) and a critical bandwidth (Bark).

Considering the worst-case approximation, the masker audio signal in a masker unit is assumed to occur at the lower edge within the masker unit when used in the upper-slope masking effect computation. This is also applied to the lower-slope masking effect computation, where the masker audio signal in the masker unit is assumed to occur at the upper edge of the masker unit.

In the SMR computation process of step S208 in FIG. 3, the SMRs (smr[u]) of all the units u are computed by the following Equation (2):

$$smr[u]=peak_energy[u]-qthreshold[u] \quad (2),$$

where u=0, 1, 2, . . . , $u_{max}-1$.

Next, in a number-of-bits computing process of step S209, assuming that the full bandwidth to be first quantized has 52 units, the number of bits available for bit allocation, available_bit, is computed by using the following Equation (3):

$$available_bit=(sound_frame-4)\times 8-(52\times 10) \quad (3),$$

where sound_frame represents the frame size in bytes and is preferably 212 bytes. In Equation (3), four bytes subtracted from sound_frame are used to code the block modes of the three subbands and the bandwidth index (amount[0]). The side information (totally 10 bits per unit) of word length index (4 bits) and side information (6 bits) including scale factor index of the 52 units are coded by 52×10 bits.

Next, in an SMR positive-conversion process of step S210, a dummy positive number is added to all SMR values so that the SMR values are made to be positive values before being used in computing the SMR-offset in an SMR-offset computing process of step S211. Then, the bandwidth to be quantized is determined in a bandwidth computing process of step S212. Next, at step S213, the SMR-offset is used in a sample bit computing process, where the number of sample bits representing the number of bits to be allocated to the units is computed. Then, in a remaining bit allocation process of step S214, the remaining bits left after the use of the sample bits for the units are then allocated to some selected units as the number of remaining available bits.

Now subroutines of the aforementioned main-routine dynamic bit allocation process, which include the absolute threshold adjusting process for the short block of step S203, the upper-slope masking effect computing process of step S206, the lower-slope masking effect computing process of step S207, the SMR-offset computing process of step S211, the bandwidth computing process of step S212, the sample bit computing process of step S213, and the remaining bit allocation process of step S214, will be described in more detail.

Figure 4:
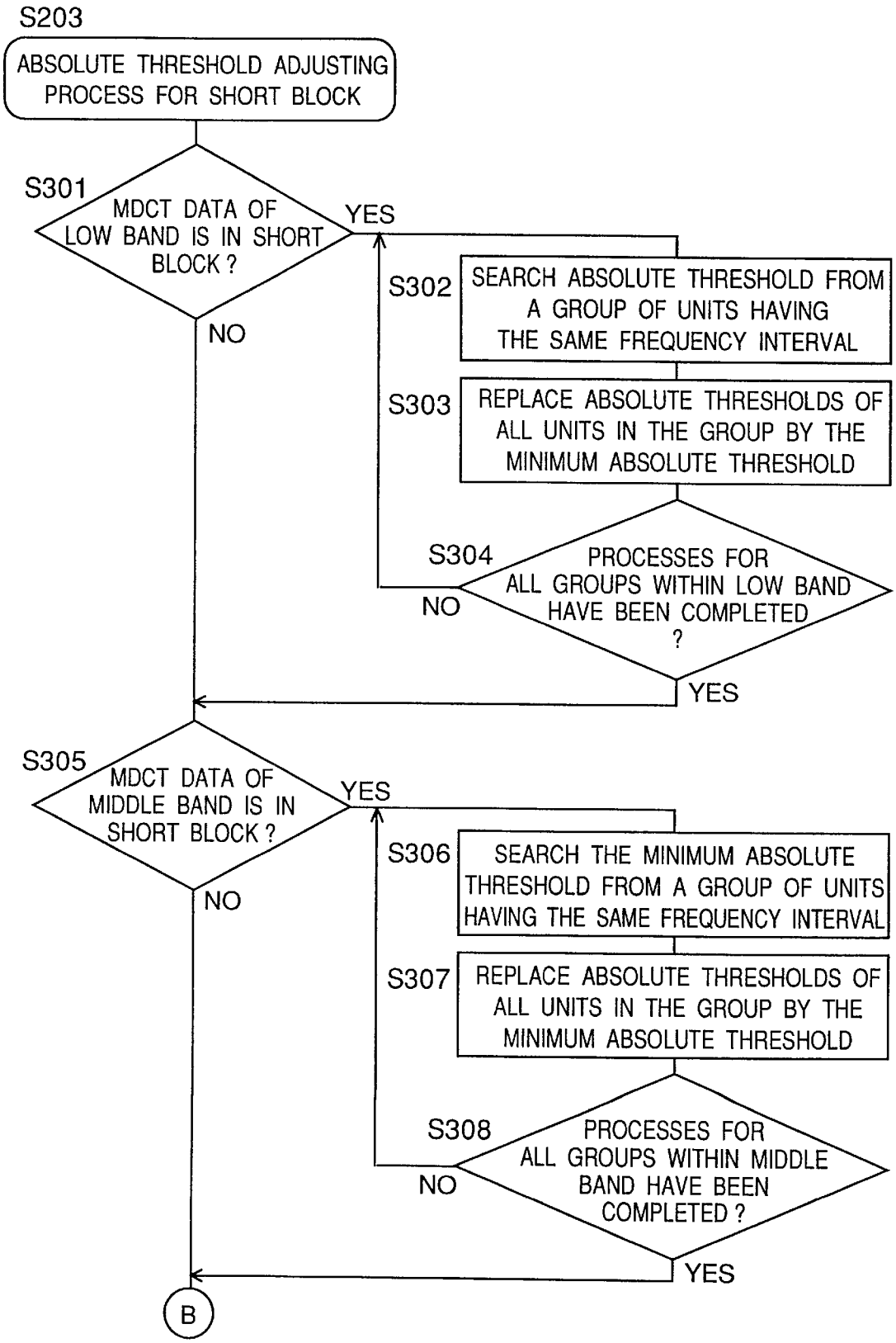
FIG. 4 is a flow chart showing a first portion of an absolute threshold adjusting process (S203) for the short block, which is a subroutine of FIG. 2.
Figure 5:
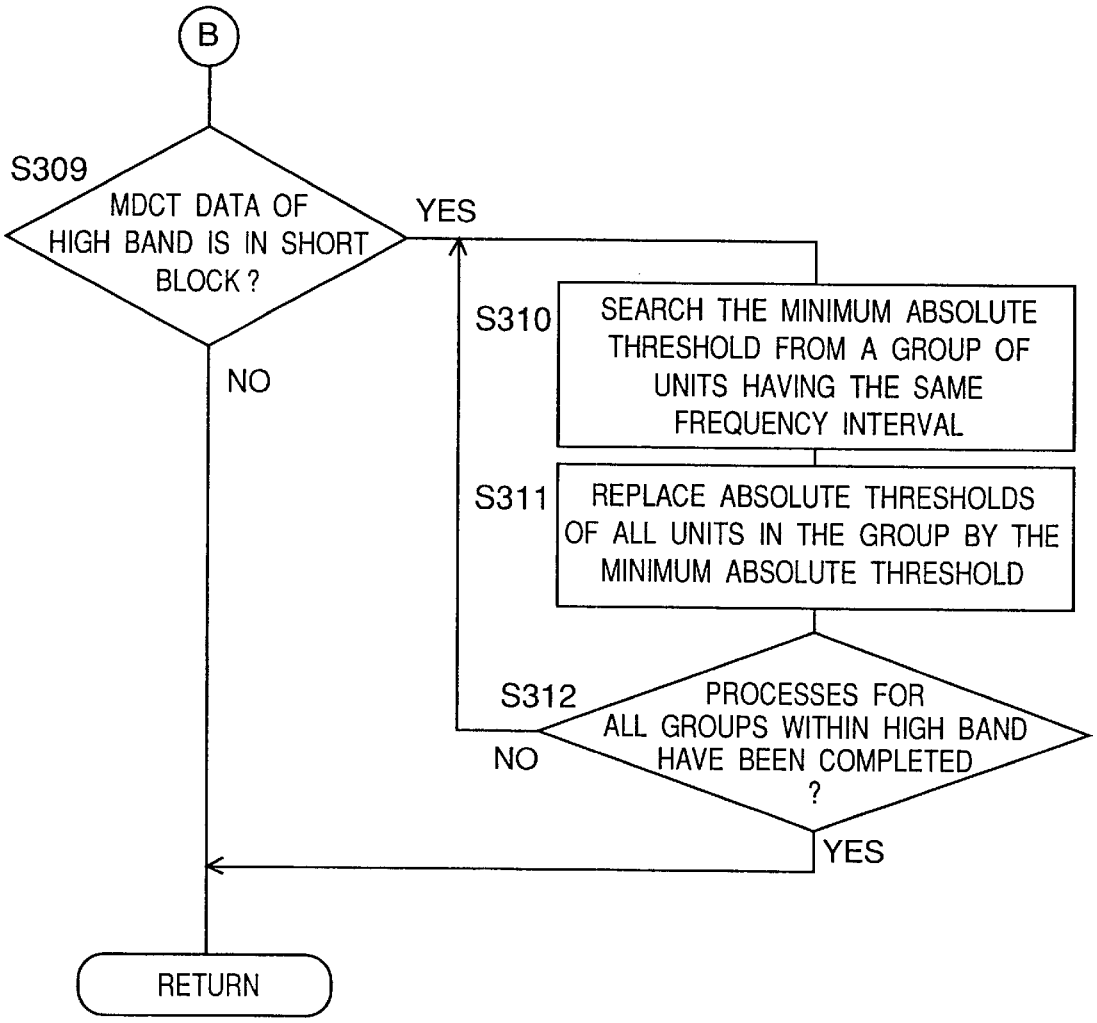
FIG. 5 is a flow chart showing a second portion of the absolute threshold adjusting process (S203) for the short block, which is a subroutine of FIG. 2.

FIGS. 4 and 5 are flow charts showing the absolute threshold adjusting process for the short block, which is a subroutine of FIG. 2.

In the system of the present preferred embodiment, the frequency band covered by one unit differs between the short block and the long block. That is, four units of the long block correspond to one unit of the short block in the low and middle bands, while eight units of the long block correspond to one unit of the short block in the high band. Therefore, the absolute threshold for units differs between the long block and the short block. In the present preferred embodiment, the absolute threshold for the long block is set at step S202, and the absolute threshold for the short block is adjusted at step S203.

At step S301 of FIG. 4, MDCT data of low frequency band is first of all checked. If the short block is used, the program flow goes to step S302, and otherwise, the program flow goes to step S305. At step S302, a minimum absolute threshold is searched or determined from a group of units having the same frequency interval but belonging to different time-frames. In the system of the preferred embodiment, in the case of the short block, a frame is divided into a plurality of time-frames. That is, a frame is divided into 4 time-frame in the low and middle bands, and a frame is divided into 8 time-frames in the high band. Accordingly, the term "time-frames" herein refers to different short blocks in the same coding frame. The original long block absolute threshold values of these units are then replaced by this minimum absolute threshold at step S303. At step S304, it is decided whether or not the processes of steps S302 and S303 have been executed for all the groups within the low band. If Yes at step S304, the program flow goes to step S305, and otherwise, the program flow returns to step S302. The processes of steps S302, S303 and S304 are repeated until all the groups within the low frequency band have been processed. In a manner similar to that of the absolute threshold adjusting process for the low band, an absolute threshold adjusting process is executed for all the groups in the middle subband at steps S305 to S308, and an absolute threshold adjusting process is executed for all the groups in the high band at steps S309 to S312 in FIG. 5. After these steps, the program flow returns to the original main routine.

FIGS. 6 and 7 are flow charts showing the upper-slope masking effect computing process (step S206), which is a subroutine of FIG. 2.

At step S401 in FIG. 6, the masker unit $u_{mr}$ is set to start at the first unit. It is noted that the term "the first unit" refers to the lowest frequency unit (u=0), and the term "the last unit" refers to the highest frequency unit ($u=u_{max-1}$) Then, at step S402, the masked unit umd is set to start at the next higher frequency unit ($u_{mr}+1$) to the masker unit $u_{mr}$. At step S403, a masking index (mask index) which depends on the critical bandwidth or Bark (bark[$u_{mr}$]) of the masker unit $u_{mr}$ is computed by using the following Equation (4):

$$\text{mask_index}=a+(b\times\text{bark}[u_{mr}]) \quad (4),$$

where a and b are arbitrary constants, and bark [$u_{mr}$] is the lower side critical-band rate boundary of the masker unit $u_{mr}$. The Bark (bark) represents the unit of critical-band rate (z). The mapping from frequency scale to critical-band rate can be performed by the following Equation (5):

$$z[\text{bark}]=13\cdot\tan^{-1}(0.76\ f)+3.5\cdot\tan^{-1}(f/7.5)^2 \quad (5),$$

where f is the frequency expressed in kHz.

Next, at step S404, the upper-slope masking effect ($\text{mask_effect}_{(upper\text{-}slope)}$) exerted on the current masked unit $u_{md}$ is computed by using the following Equation (6):

$$\text{mask_effect}_{(upper\text{-}slope)}=\text{peak_energy}[u_{mr}]-\text{mask_index}-\{(\text{bark}[u_{md}]-\text{bark}[u_{mr}])\times 10.0\} \quad (6),$$

where bark[$u_{md}$] is the upper critical-band rate boundary of the masked unit $u_{md}$ and bark[$u_{mr}$] is the lower critical-band rate boundary of the masker unit $u_{mr}$.

At step S405, if such branch conditions are satisfied that the upper-slope masking effect ($\text{mask_effect}_{(upper\text{-}slope)}$) is larger than the lowest absolute threshold within all the masked units and that the masked unit $u_{md}$ is lower in frequency than the last unit or is the last unit are satisfied, then the program flow goes to step S406 of FIG. 7, and otherwise, the program flow goes to step S410.

At step S406 of FIG. 7, if the upper-slope masking effect ($\text{mask_effect}_{(upper\text{-}slope)}$) is larger than the absolute threshold (qthreshold [$u_{md}$]) of the masked unit $u_{md}$, then the program flow goes to step S407, where the absolute threshold (qthreshold [$u_{md}$]) of the masked unit $u_{md}$ is set to the upper-slope masking effect ($\text{mask_effect}_{(upper\text{-}slope)}$), then the program flow goes to step S408. On the other hand, at step S406, if the upper-slope masking effect ($\text{mask_effect}_{(upper\text{-}slope)}$) is not larger than the absolute threshold (qthreshold [$u_{md}$]) of the masked unit $u_{md}$, then the program flow goes directly to step S408. Then at step S408, the masked unit $u_{md}$ is incremented to the next higher unit ($u_{md}+1$). Further at step S409, the upper-slope masking effect ($\text{mask_effect}_{(upper\text{-}slope)}$) for the current masked unit $u_{md}$ is computed again by using Equation (6) shown above.

The processes of steps S406 to S409 are repeated in a loop until the upper-slope masking effect ($\text{mask_effect}_{(upper\text{-}slope)}$) is tested to be smaller than the lowest absolute threshold in all the units or until the masked unit $u_{md}$ is set to be higher than the last unit (until such a branch state is obtained) at step S405. Once this branch state has occurred (NO at step S405), the masker unit $u_{mr}$ is set to the next higher frequency unit ($u_{mr}+1$) at step S410 of FIG. 6. The processes of steps S402 to S410 are repeated until the masker unit $u_{mr}$ is verified to be equal to the last unit at step S411. If the masker unit $u_{mr}$ has become equal to the last unit (YES at step S411), then the upper-slope masking effect computing process is completed, and subsequently a lower-slope masking effect computing process of step S207 of the main routine is executed.

Figure 9:
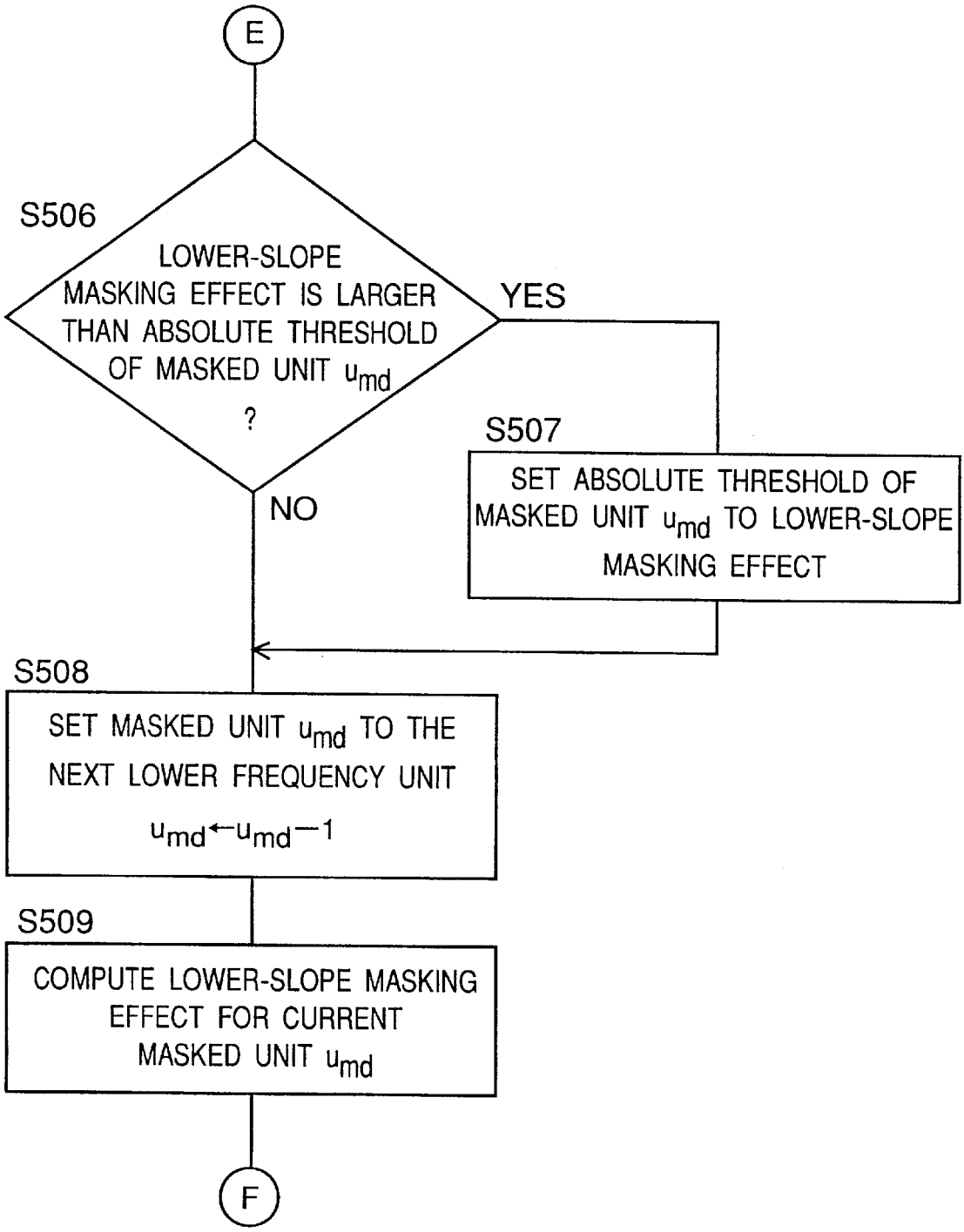
FIG. 9 is a flow chart showing a second portion of the lower-slope masking effect computing process (step S207) which is a subroutine of FIG. 2.

FIGS. 8 and 9 are flow charts showing the lower-slope masking effect computing process (step S207) which is a subroutine of FIG. 2.

At step S501 in FIG. 8, the masker unit $u_{mr}$ is set to start at the last unit. Then at step S502, the masked unit $u_{md}$ is set to start at the next lower frequency unit ($u_{mr}-1$) to the masker unit $u_{mr}$. At step S503, in a manner similar to that of the upper-slope masking effect computing process, the masking index (mask_index) is computed by using Equation (4) shown above. Then, at step S504, the lower-slope masking effect ($\text{mask_effect}_{(lower\text{-}slope)}$) is computed by using the following Equation (7):

$$\text{mask_effect}_{(lower\text{-}slope)}=\text{peak_energy}[u_{mr}]-\text{mask_index}-\{(\text{bark}[u_{mr}]-\text{bark}[u_{md}])\times 27.0\} \quad (7),$$

where bark[$u_{md}$] is the lower critical-band rate boundary of the masked unit $u_{md}$ and bark[$u_{mr}$] is the upper critical-band rate boundary of the masker unit $u_{mr}$.

At step S505, if such branch conditions are satisfied that the lower-slope masking effect ($\text{mask_effect}_{(lower\text{-}slope)}$) is larger than the lowest absolute threshold within all the masked units and that the masked unit $u_{md}$ is higher in frequency than the first unit or is the first unit, then the program flow goes to step S506 of FIG. 9. Otherwise, the program flow goes to step S510.

At step S506 of FIG. 9, the lower-slope masking effect ($\text{mask_effect}_{(lower\text{-}slope)}$) is compared with the absolute threshold (qthreshold [$u_{md}$]) of the masked unit $u_{md}$, where if the lower-slope masking effect ($\text{mask_effect}_{(lower\text{-}slope)}$) is larger than the absolute threshold (qthreshold [$u_{md}$]), then the program flow goes to step S507, and otherwise, then the program flow goes to step S508. At step S507, the absolute threshold (qthreshold [$u_{md}$]) of the masked unit $u_{md}$ is set to the lower-slope masking effect ($\text{mask_effect}_{(lower\text{-}slope)}$), and then, the program flow goes to step S508.

It should be noted that the absolute threshold may have already been modified by the upper-slope masking effect ($\text{mask_effect}_{(upper\text{-}slope)}$) prior to steps S506 and S507. Therefore, as the final processing result, the highest masking threshold is selected from among the absolute threshold (qthreshold [$u_{md}$]) of the masked unit $u_{md}$, the upper-slope masking effect ($\text{mask_effect}_{(upper\text{-}slope)}$) and the lower-slope masking effect ($\text{mask_effect}_{(lower\text{-}slope)}$) to represent the level of the masking absolute threshold (qthreshold [$u_{md}$]) of the masked unit $u_{md}$.

Once the current masked unit $u_{md}$ has been processed, the masked unit $u_{md}$ is decremented to the next lower frequency unit at step S508. Then, at step S509, the new lower-slope masking effect ($\text{mask_effect}_{(lower\text{-}slope)}$) is computed again using Equation (7). The processes of steps S505 to S509 are repeated until the lower-slope masking effect ($\text{mask_effect}_{(lower\text{-}slope)}$) is tested smaller than the lowest absolute threshold or the masked unit $u_{md}$ is set to be smaller than the first unit at step S505. In such a case, if NO at step S505, the masker unit $u_{mr}$ is set to the next lower frequency unit ($u_{mr}-1$) at step S510 of FIG. 8. At step S511, if the masker unit $u_{mr}$ has not reached the first unit, the program flow returns to step S502. The processes of steps S502 to S510 are repeated until the masker unit $u_{mr}$ reaches the first unit. If YES at step S511, the program flow returns to the original main routine.

Figure 10:
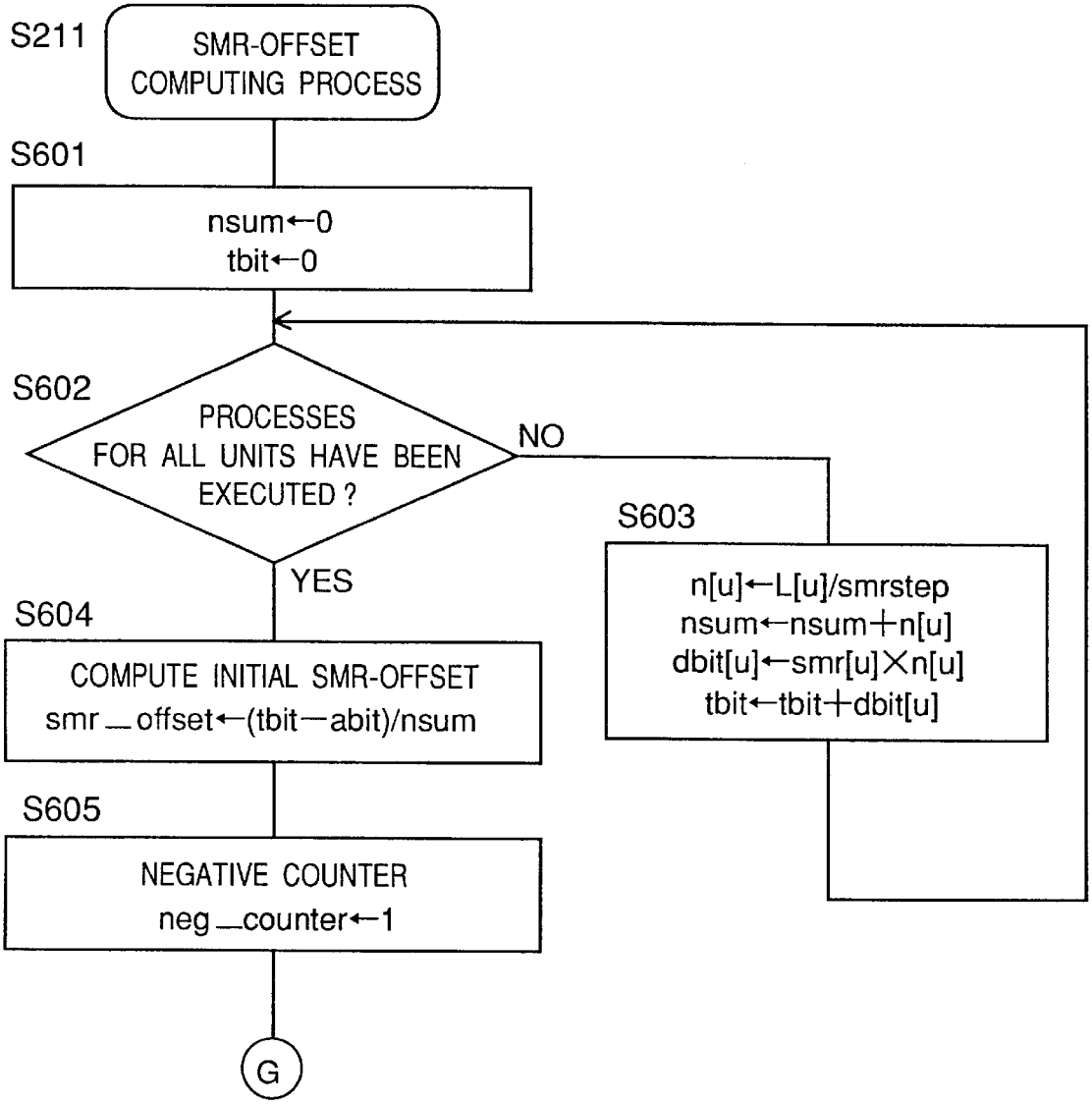
FIG. 10 is a flow chart showing a first portion of an SMR-offset computing process (S211) which is a subroutine of FIG. 3.
Figure 11:
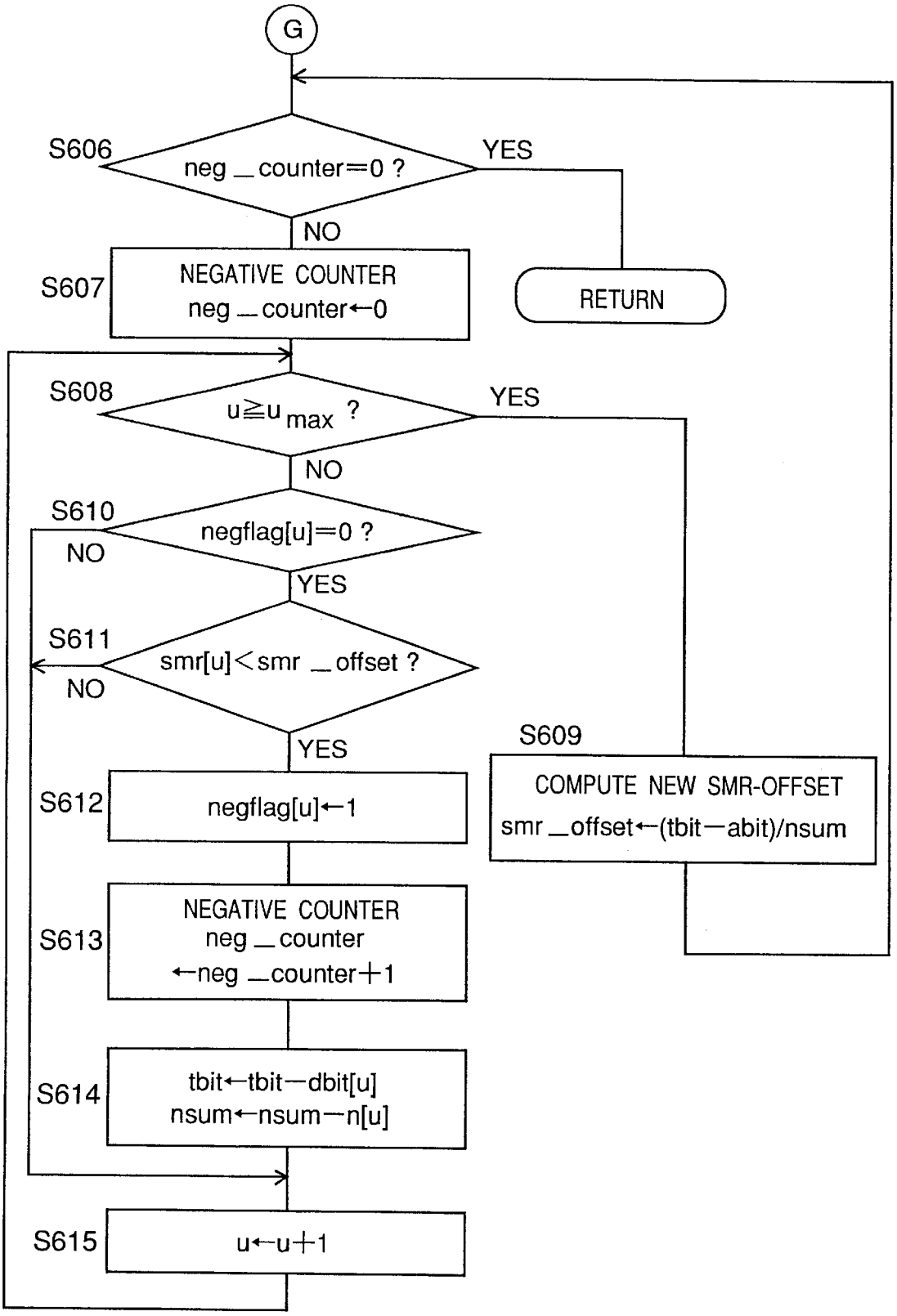
FIG. 11 is a flow chart showing a second portion of the SMR-offset computing process (S211) which is a subroutine of FIG. 3.

FIGS. 10 and 11 show flow charts of the SMR-offset computing process at step S211 of FIG. 3. In the processes of steps S601 to S604, the initial SMR-offset is computed according to the following Equations (8) to (15):

$$\text{abit}=\{(\text{smr}[0]-\text{smr_offset})/\text{smrstep}\}\times L[0]+\{(\text{smr}[1]-\text{smr_offset})/\text{smrstep}\}\times L[1]+\ldots+\{(\text{smr}[u_{max}-1]-\text{smr_offset})/\text{smrstep}\}\times L[u_{max}-1] \quad (8),$$

where abit is the number of available bits representing the number of bits available for bit allocation, tbit represents the total number of bits required to satisfy the SMR of all units, L[u] represents the number of spectral lines in the unit u, $u_{max}$ represents the total number of units, smr[u] represents the SMR of the unit u, smr_offset represents the SMR-offset, and smrstep represents the SMR reduction step for allocating one sample bit in dB.

Now if the parameter n[u] for the unit u is defined as shown by the following Equation (9), then Equation (8) is replaced by Equation (10), where the total number of bits (tbit) required to satisfy the SMR of all the units is expressed by Equation (11):

$$n[u]=L[u]/smrstep \quad (9),$$

$$abit=(smr[0]-smr_offset)\times n[0]+(smr[1]-smr_offset)\times n[1]+\ldots+(smr[u_{max}-1]-smr_offset)\times n[u_{max}-1] \quad (10), \text{ and}$$

$$tbit=smr[0]\times n[0]+smr[1]\times n[1]+\ldots+smr[u_{max}-1]\times n[u_{max}-1] \quad (11).$$

Therefore, the following Equation (12) holds, and the SMR-offset (smr_offset) is computed by Equation (13):

$$tbit-abit=smr_offset\times n[0]+smr_offset\times n[1]+\ldots+smr_offset\times n[u_{max}-1] \quad (12), \text{ and}$$

$$smr_offset=(tbit-abit)/(n[0]+n[1]+\ldots+n[u_{max}-1]) \quad (13).$$

Here, a variable nsum is defined by the following Equation (14) and a variable dbit is defined by Equation (15):

$$nsum=n[0]+n[1]+\ldots+n[u_{max}-1] \quad (14), \text{ and}$$

$$dbit[u]=smr[u]\times n[u] \quad (15).$$

In this application, the SMR reduction step (smrstep) is chosen to be 6.02 dB. This value represents an approximated signal-to-noise ratio (SNR) improvement for each bit being allocated to a linear quantizer. There are some cases where the SMRs of some units are smaller than the SMR-offset (smr_offset) and when this occurs, those units may receive negative bit allocation. A sequence of the processes of steps S605 to S614 in FIGS. 10 and 11 ensure that those units participated in the SMR-offset (smr_offset) computation have an SMR (smr[u]) larger than the SMR-offset (smr_offset). This can be achieved through an iterative elimination loop.

FIGS. 10 and 11 are flow charts showing an SMR-offset computing process (S211) which is a subroutine of FIG. 3.

Referring to FIG. 10, the variable nsum and the variable tbit are initialized each to zero at step S601. Then at steps S602 and S603, parameters n[u] and dbit[u] for all the units are computed by Equations (9) and (11), while the parameters of variables nsum and tbit are computed in advance by Equations (14) and (15). Then at step S604, the initial value of SMR-offset (smr_offset) is computed by Equation (13) shown above. Also at step S605, a negative counter (neg_counter), which serves as a decision criterion as to whether or not this SMR-offset computing process is completed, is set to one.

Subsequently at step S606 of FIG. 11, it is decided whether or not such an ending condition that the negative counter (neg_counter) is zero is satisfied. If the ending condition is satisfied, the SMR-offset computing process is completed, then the program flow goes to step S211 of FIG. 3 in the original main routine, and otherwise, the program flow goes to step S607. At step S607, the negative counter (neg_counter) is set to zero. Then in order to execute the processes of steps S608 to S615 for all the units, it is decided at step S608 whether or not such a condition that $u \geqq u_{max}$ is satisfied. If the condition is satisfied, then the program flow goes to step S609, and otherwise, the program flow goes to step S610. At step S610, it is decided whether or not such a condition that a negative flag (negflag[u]) is zero is satisfied, where if the condition is not satisfied, the program flow goes to step S615. On the other hand, if the condition is satisfied, the program flow goes to step S611. At step S611, the SMR (smr[u]) of the unit u is compared with the SMR-offset (smr_offset), where if the SMR (smr[u]) is equal to or larger than the SMR-offset (smr_offset), the program flow goes to step S615. On the other hand, if the SMR (smr[u]) is smaller than the SMR-offset (smr_offset), the program flow goes to step S612. Then at step S612, in order to identify the unit u having an SMR (smr[u]) smaller than the SMR-offset (smr_offset), the negative flag (negflag[u]) of the unit u is set to one so that the unit u is prevented from participating in the new SMR-offset (smr_offset) computation. At step S613, the negative counter (neg_counter) is set by incrementing the counter by one. Then at step S614, the variable tbit of Equation (11) is updated by subtracting or removing the unwanted number dbit[u]=smr[u]×n[u] from the current value of the variable tbit, and the variable nsum representing the summation of variables n[u] of Equation (14) is updated by subtracting (or removing) the unwanted variable n[u] from the current value of the variable nsum. This subtraction or removal process means eliminating the unit u from the SMR-offset computing process. It is noted that the variable u denotes the unit number of the unit that is prevented from participating in the SMR-offset computation, i.e., the unit number of the unit that should be eliminated and that has an SMR smaller than the SMR-offset (smr_offset). Next, at step S615, the unit number u is set by incrementing the number by one, then the program flow returns to step S608.

If it is decided at step S608 that the processes of steps S610 to S615 have been executed on all the units, then the program flow goes to step S609. At step S609, a new SMR-offset (smr_offset) is re-computed by Equation (13) shown above, then the program flow returns to step S606.

At these steps, this new SMR-offset (smr_offset) is recursively used and computed in the elimination process until the SMR-offset (smr_offset) becomes smaller than any of the SMRs of all the units participating in the computation process.

Figure 12:
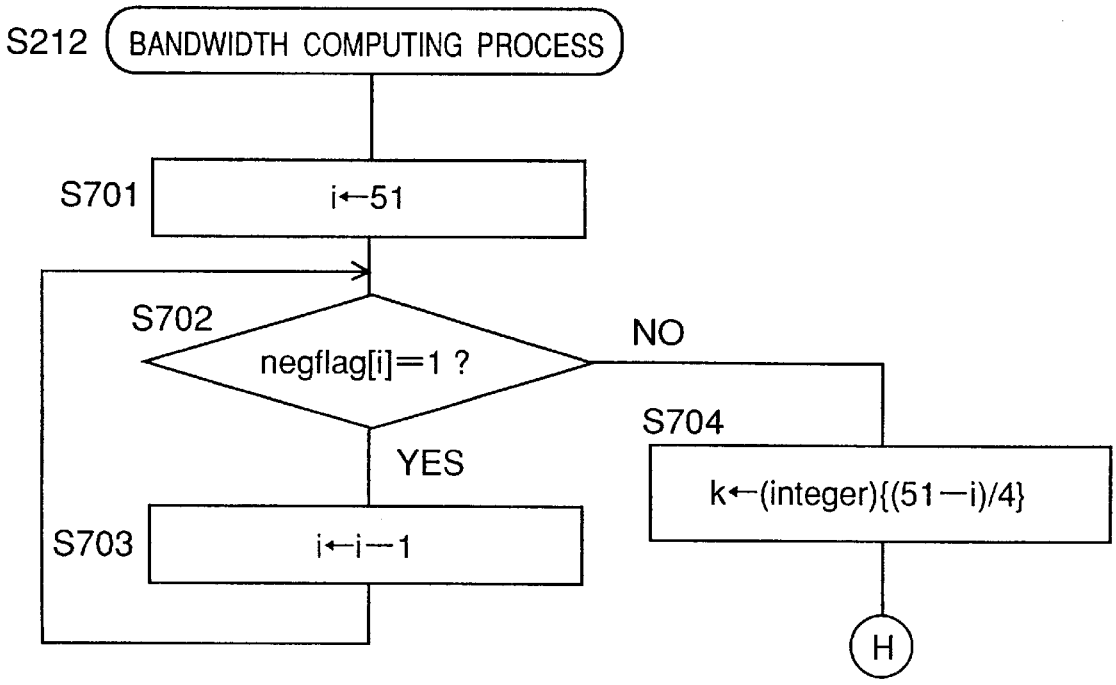
FIG. 12 is a flow chart showing a first portion of a bandwidth computing process (S212) which is a subroutine of FIG. 3.
Figure 13:
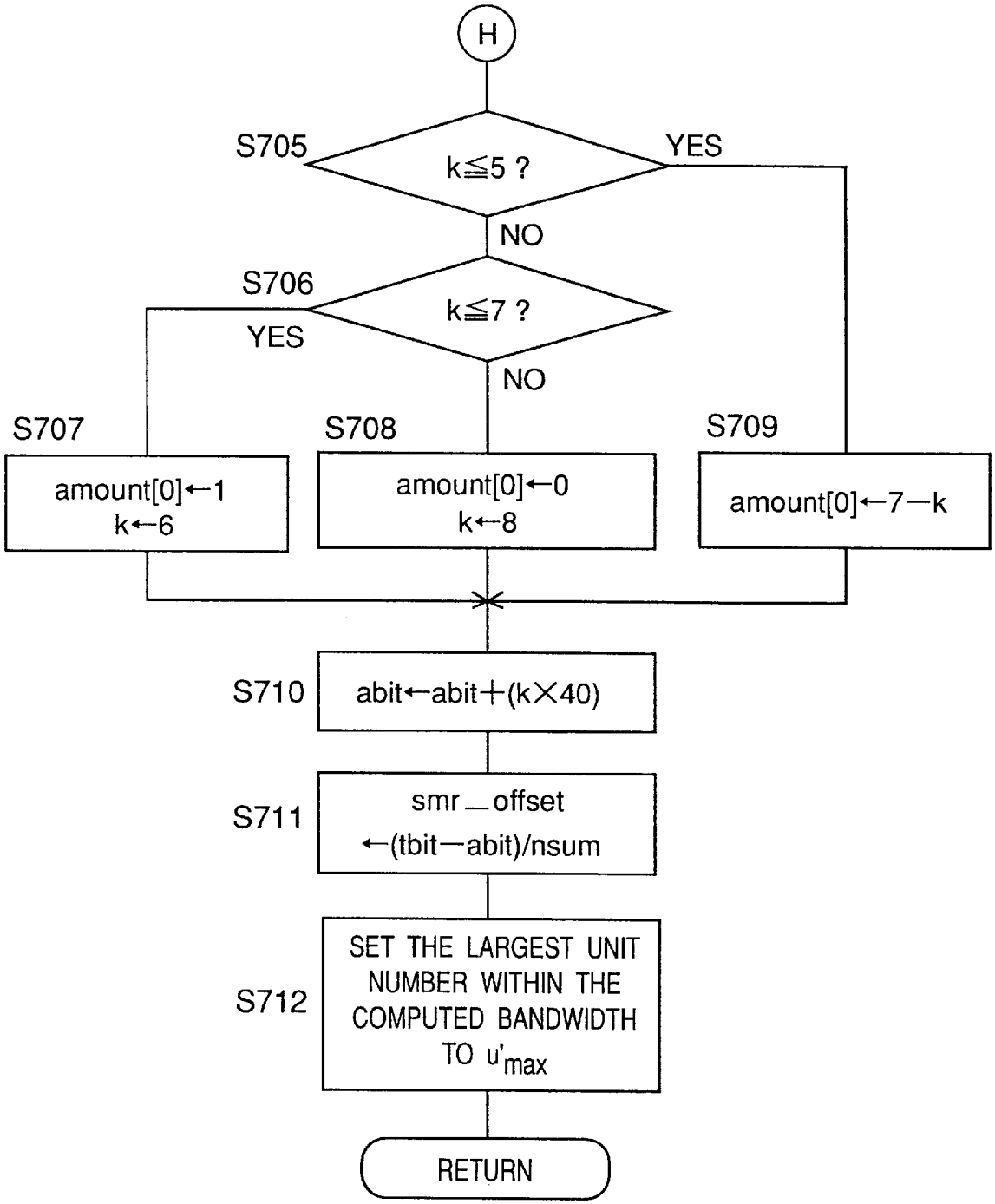
FIG. 13 is a flow chart showing a second portion of the bandwidth computing process (S212) which is a subroutine of FIG. 3.

FIGS. 12 and 13 are flow charts showing the bandwidth process (S212) which is a subroutine of FIG. 3. The units represented by the bandwidth index, amount[0], in the following table.

TABLE 3

| Bandwidth index amount [0] | Unit name | Number of Units |
|---|---|---|
| 0 | unit 0, unit 1, . . . , unit 19 | 20 |
| 1 | unit 0, unit 1, . . . , unit 27 | 28 |
| 2 | unit 0, unit 1, . . . , unit 31 | 32 |
| 3 | unit 0, unit 1, . . . , unit 35 | 36 |
| 4 | unit 0, unit 1, . . . , unit 39 | 40 |
| 5 | unit 0, unit 1, . . . , unit 43 | 44 |
| 6 | unit 0, unit 1, . . . , unit 47 | 48 |
| 7 | unit 0, unit 1, . . . , unit 51 | 52 |

Referring to FIG. 12, first of all, at step S701, a variable i is set to 51, which is the last unit number. Then at step S702, if such a condition that a negative flag (negflaf[i]) is 1 is satisfied, then the program flow goes to step S703, and otherwise, the program flow goes to step S704. At step 703, the variable i is set by decrementing the variable by one, and the process of step S702 is redone. That is, at steps S701 to S703, the number of consecutive units with the negative flag negflag[u]=1 is counted starting from the last unit $u_{max}-1$ and the counting process will be stopped whenever a unit u with the negative flag negflag[u]=0 is encountered. At step S704, the count (51−i) is then converted into an index k as an integral number computed by the following Equation (16), then the program flow goes to step S705:

$$k=(\text{integer})\{(51-i)/4\} \quad (16),$$

where (integer){·} represents an integer-truncation operation.

Depending on the index k value, the bandwidth index amount[0] is determined and the index k is adjusted if necessary at steps S705 to S709. Referring to FIG. 13, first of all, at step S705, if such a condition that the index k is equal to or smaller than 5 is satisfied, then the program flow goes to step S709. Otherwise, the program flow goes to step S706. At step S706, the program flow is branched by such a condition that the index k is equal to or smaller than 7. If the branch condition is satisfied, then the program flow goes to step S707, and otherwise, the program flow goes to step S708. At step S707, the bandwidth index amount [0] is set to one, the index k is set to six, and then, the program flow goes to step S710. At step S708, the bandwidth index amount [0] is set to zero, the index k is set to eight, and then, the program flow goes to step S710. At step S709, the bandwidth index amount [0] is set to 7−k, and then, the program flow goes to step S710. At step S710, the number of available bits, abit, is updated by the following Equation (17):

$$\text{abit}\leftarrow\text{abit}+(k\times 40) \quad (17),$$

where the index k is an indication of how many units can be removed in the bandwidth determination and the actual number of units removed is (k×4).

It should be noted that for every unit being removed, 10 bits can be recovered from the side information of word length index WLindex[u] (4 bits) and scale factor index sfindex[u] (6 bits), and that the recovered bits can be allocated for other units. The recovered bits are added to the number of available bits, abit, in Equation (17) at step S710.

Next, at step S711, the SMR-offset (smr_offset) is re-computed using Equation (13), and at step S712, the largest unit number within the computed bandwidth is assumed as $u'_{max}$. When the process of step S712 is completed, the bandwidth computing process is completed, where the program flow returns to the original main routine to execute the sample bit computing process of step S213 of FIG. 13.

Figure 14:
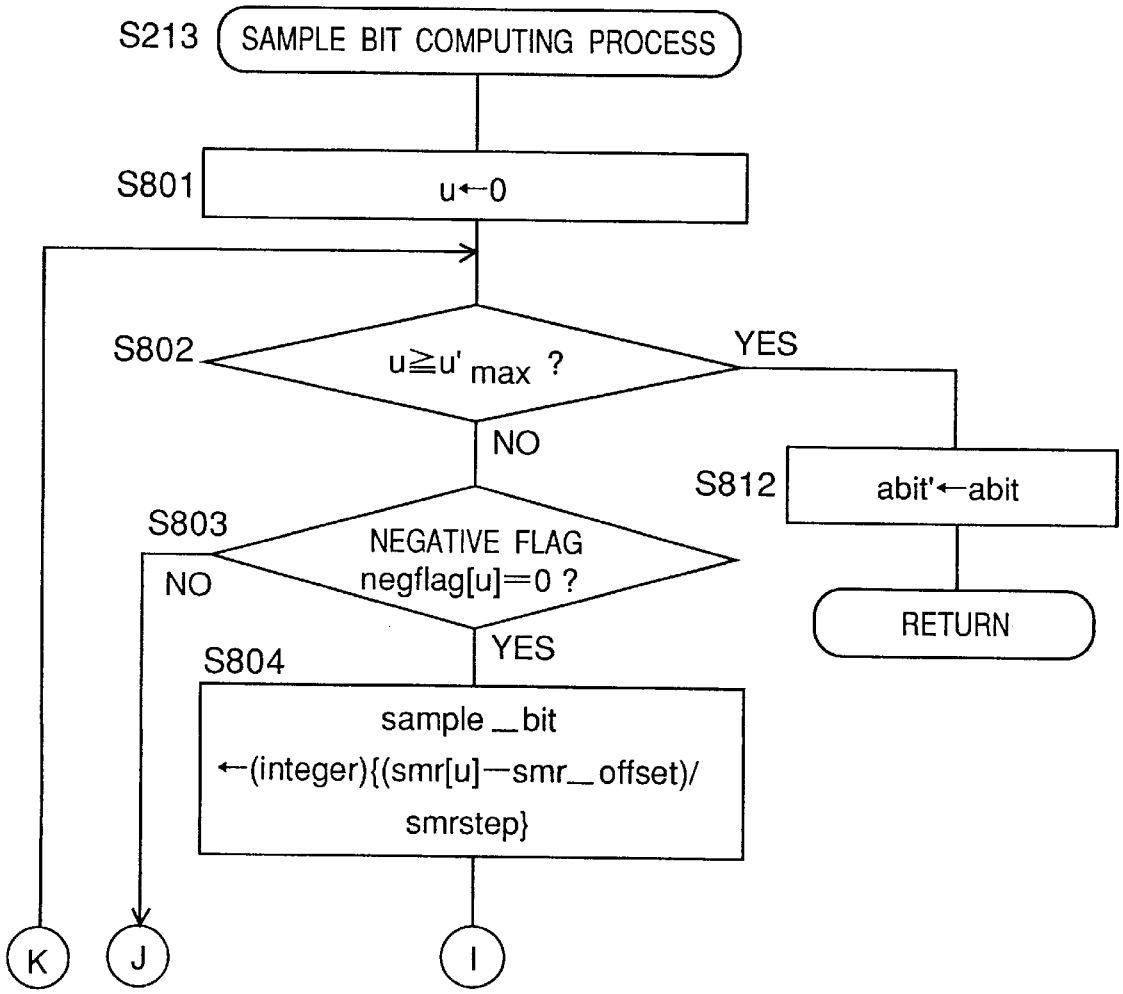
FIG. 14 is a flow chart showing a first portion of a sample bit computing process (S213) which is a subroutine of FIG. 3.
Figure 15:
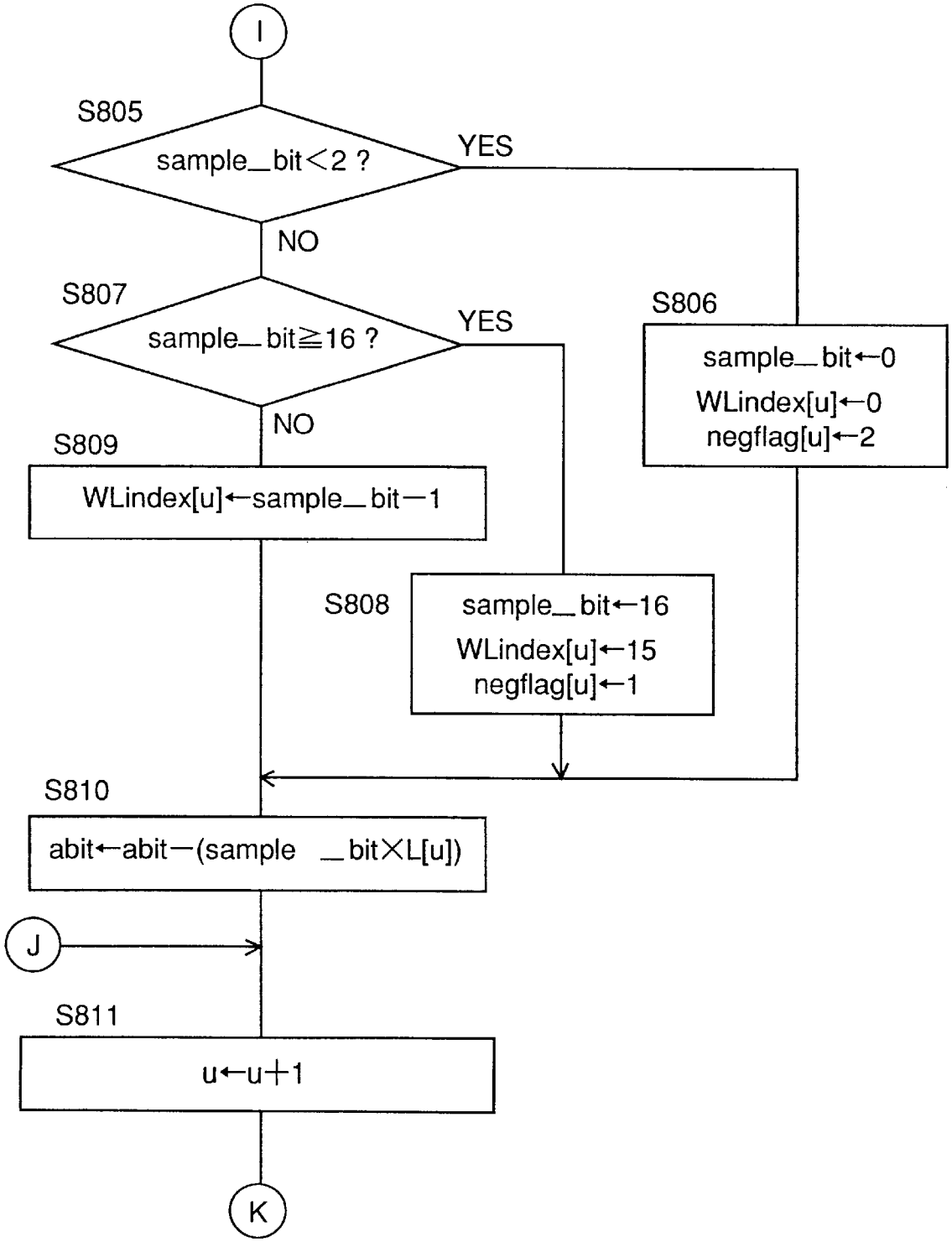
FIG. 15 is a flow chart showing a second portion of the sample bit computing process (S213) which is a subroutine of FIG. 3.

FIGS. 14 and 15 are flow charts of the sample bit computing process which is a subroutine of FIG. 3.

Referring to FIG. 14, in this process, a process of bit allocation for units is performed. First of all, at step S801, the unit number u is set to zero. Then at step S802, if such an ending condition that $u \geqq u'_{max}$ is satisfied, the program flow goes to step S812, and otherwise, the program flow goes to step S803. It is noted that the largest unit number within the bandwidth computed in the bandwidth computing process is assumed as $u'_{max}$. At step S803, it is decided whether or not the negative flag negflag[u]=0. If YES at step S803, the program flow goes to step S804, and otherwise, the program flow goes to step S811 of FIG. 14. At step S804, the following Equation (18) is used to compute the sample bit (sample bit) for each selected unit, where the number of units within the computed bandwidth is assumed as $u'_{max}$:

$$\text{sample_bit}\leftarrow(\text{integer})\ ((\text{smr}[u]-\text{smr_offset})/\text{smrstep}) \quad (18),$$

where (integer){·}represents an integer-truncation operation.

The sample bit (sample_bit) representing the number of bits to be allocated per spectral line of the unit is only computed for units u which are present in the bandwidth computed in the bandwidth computing process and in which the negative flag (negflag[u]) is 0, as shown at steps S802 to S804. Zero sample bit (sample_bit) is returned to the other units.

Figure 20:
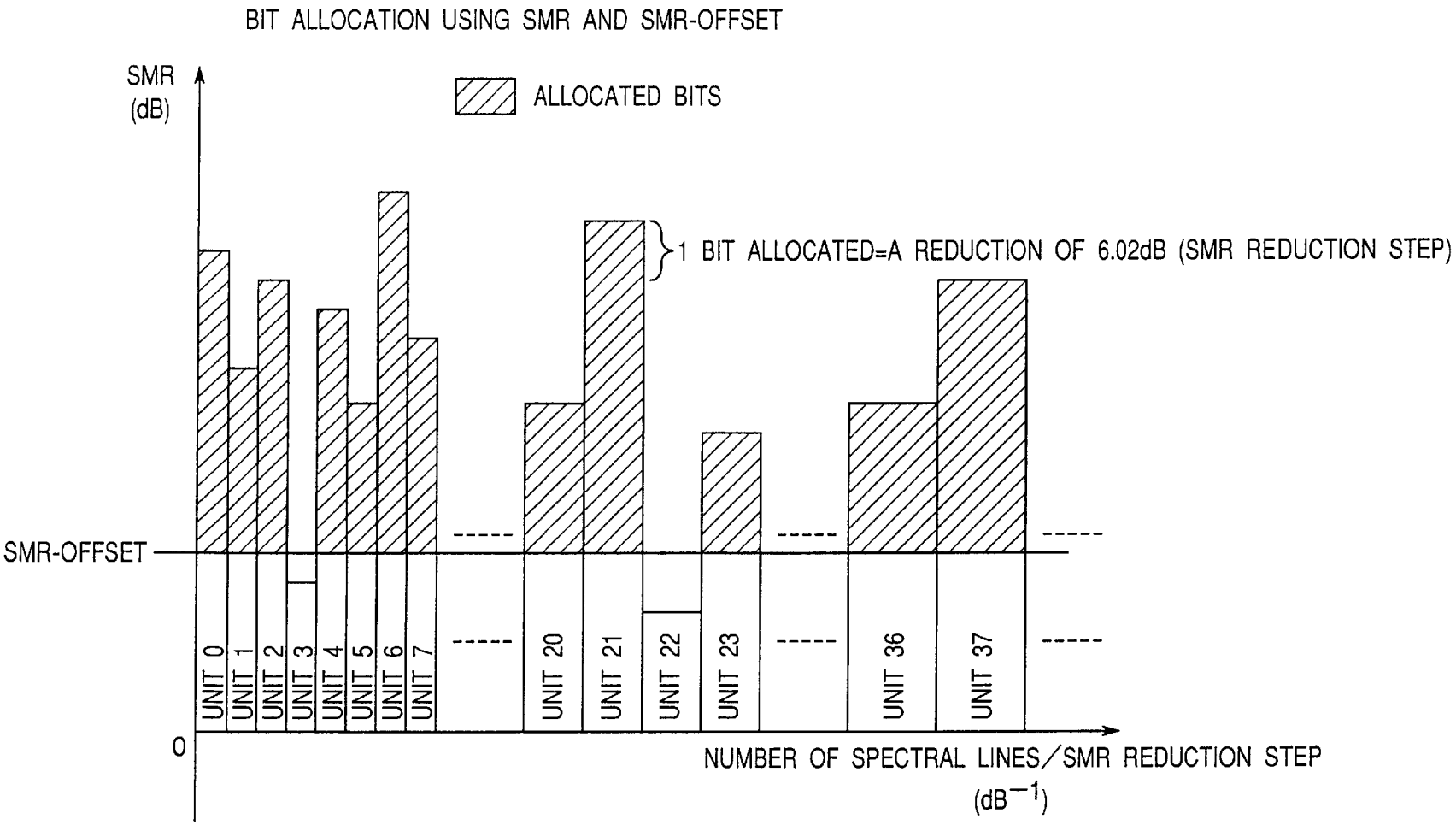
FIG. 20 is a graph showing a bit allocation using the SMR and the SMR-offset in the sample bit computing process of FIGS. 14 and 15, the graph showing a relationship between an SMR (dB) and the number of spectral lines/SMR reduction step ($dB^{-1}$)

The concept of bit allocation using SMR and SMR-offset is illustrated in FIG. 20. FIG. 20 is a graph showing a modeled bit allocation using the SMR and the SMR-offset in the sample bit computing process of FIGS. 14 and 15, the graph representing the relationship between SMR (dB) and the number of spectral lines/SMR reduction step (dB−1). As explained before, the SMR reduction step (smrstep) is set to 6.02 dB.

Once the sample bit (sample_bit) has been computed for the unit at step S804, the sample bit (sample_bit) is subjected to some adjustment at steps S805 to S809 of FIG. 15 if its value falls outside the allowable range. More specifically, at step S805, it is decided whether or not such a condition that the sample bit (sample_bit) is smaller than 2 is satisfied, where if the condition is satisfied, then the program flow goes to step S806, and otherwise, the program flow goes to step S807. At step S806, the sample bit (sample_bit) is set to zero, the word length index (WLindex [u]) is set to zero, the negative flag (negflag[u]) is set to two, and then, the program flow goes to step S810. On the other hand, at step S807, it is decided whether or not such a condition that the sample bit (sample_bit) is greater than or equal to 16 is satisfied, where if the condition is satisfied, the program flow goes to step S808, and otherwise, the program flow goes to step S809. At step S808, the sample bit (sample_bit) is set to 16, the word length index (WLindex [u]) is set to 15, the negative flag (negflag[u]) is set to one, and then, the program flow goes to step S810. At step S809, the word length index (WLindex[u]) is set to a value of sample_bit−1, and the program flow goes to step S810.

That is, the word length index WLindex[u] and the negative flag (negflag [u]) of the unit u are set along the above processes, where if the sample bit (sample_bit) of the unit u is smaller than 2, the negative flag (negflag[u]) is set to two. If the sample bit (sample_bit) is greater than or equal to 16, the negative flag (negflag[u]) is set to one. The setting of negative flag (negflag[u]) will be used in the remaining bit allocation process of step S214 of FIG. 3. The mapping of sample bits (sample_bit) to word length index (WLindex [u]) is shown as follows.

TABLE 4

| Sample bit sample_bit | Word length index Wlindex [u] |
|---|---|
| 0 → | 0 |
| 2 → | 1 |
| 3 → | 2 |
| . . . | . . . |
| . . . | . . . |
| 15 → | 14 |
| 16 → | 15 |

Next, at step S810, the number of available bits (abit) is reduced by a number resulting from multiplying the sample bit (sample_bit) of the unit u by the number of spectral lines (L[u]) as shown by the following Equation (19):

$$abit \leftarrow abit-(sample_bit \times L[u]) \quad (19).$$

Next at step S811, the unit u is set by incrementing the unit by one, and the program flow returns to the process of step S802. When the processes of steps S803 to S811 have been done for all the units, the program flow moves from step S802 to step S812. At step S812, the value of abit, which is the final result of subtracting the number of bits allocated to all the units from the total number of available bits, is substituted for the number of remaining available bits (abit'), where the sample bit computing process is completed, and then, the program flow goes to step S214 of FIG. 3, which is the original main routine.

Figure 16:
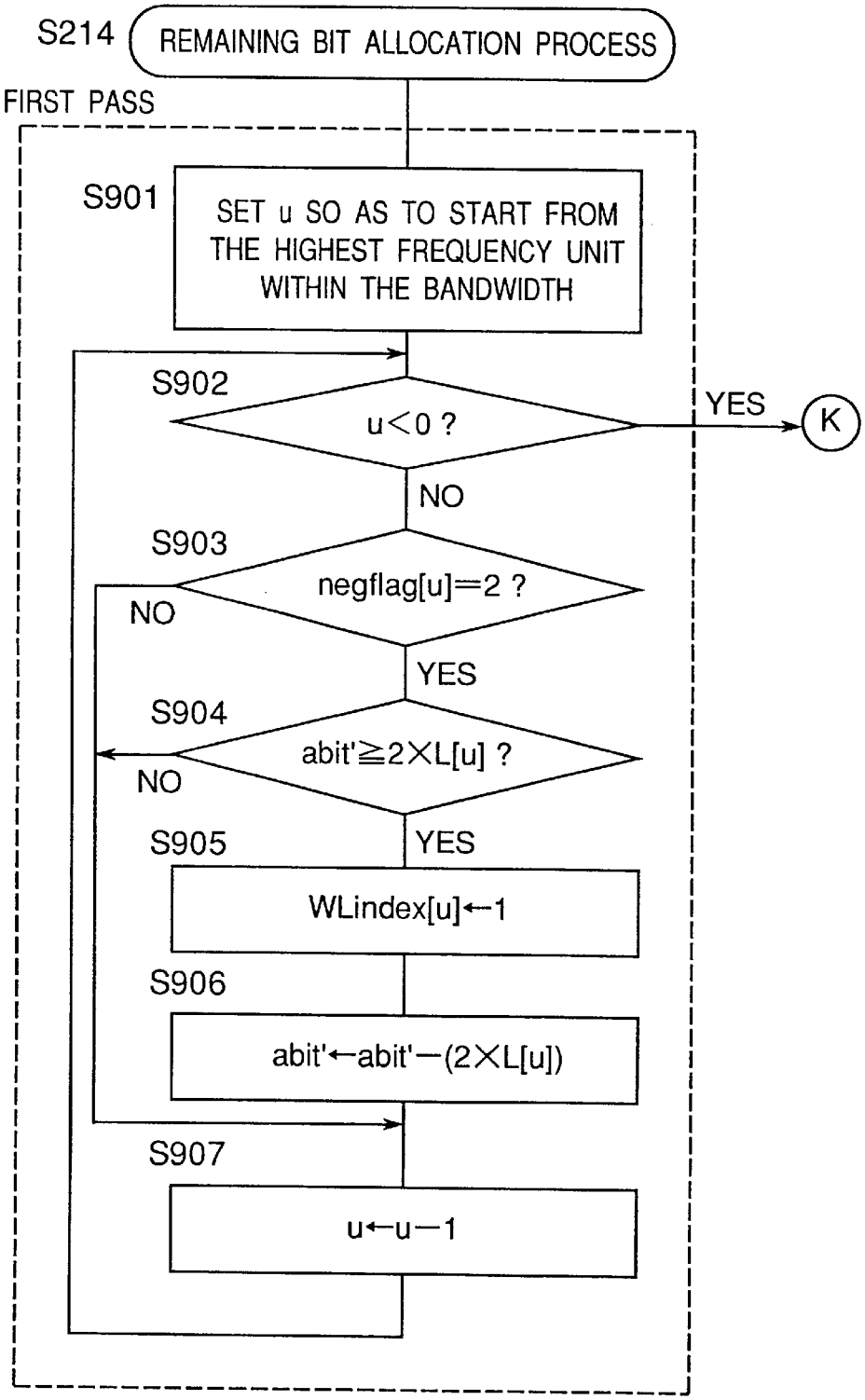
FIG. 16 is a flow chart showing a first portion of a remaining bit allocation process (S214) which is a subroutine of FIG. 3.
Figure 17:
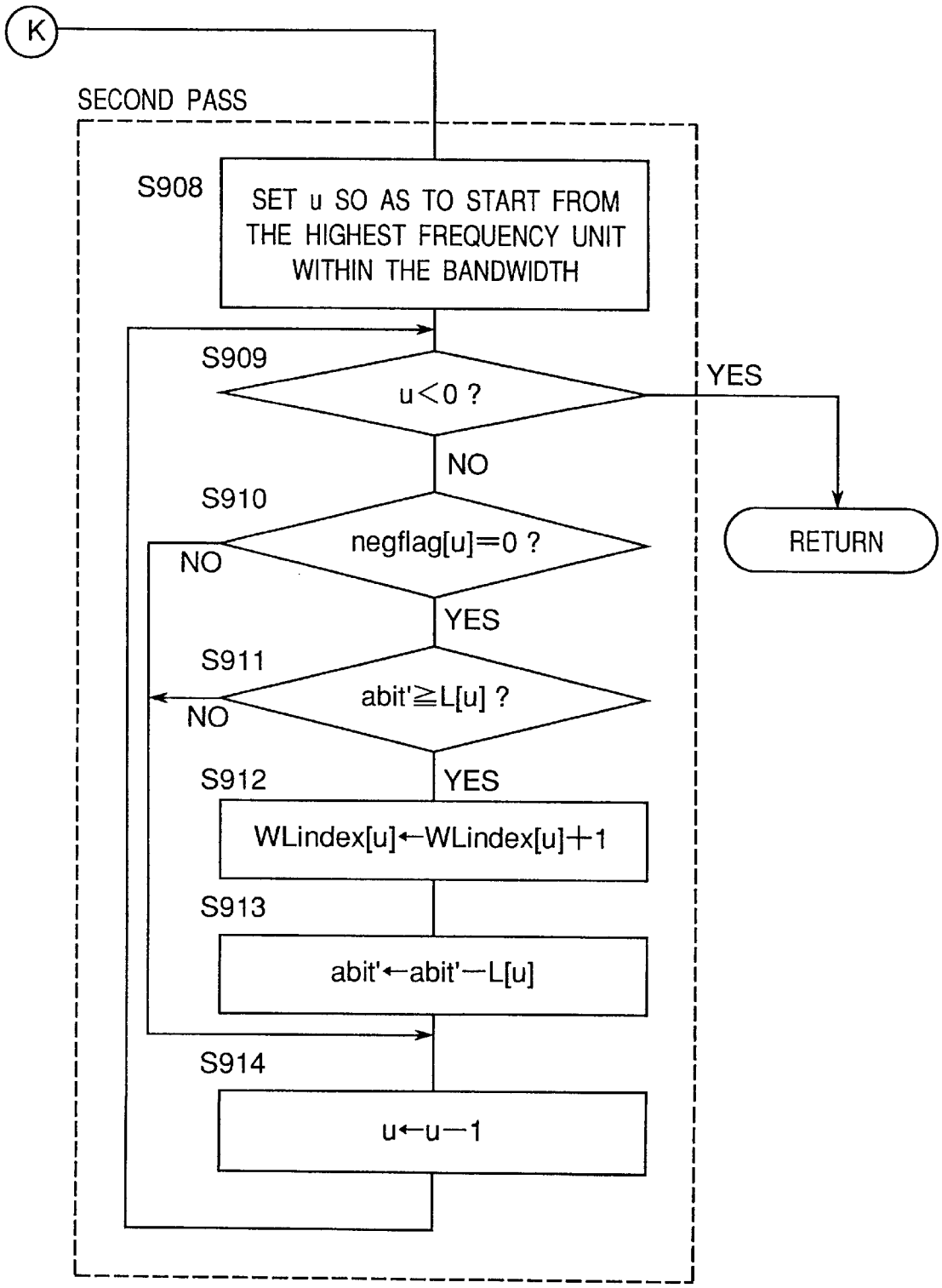
FIG. 17 is a flow chart showing a second portion of the remaining bit allocation process (S214) which is a subroutine of FIG. 3.

FIGS. 16 and 17 are flow charts of the remaining bit allocation process (S214) which is a subroutine of FIG. 3. In this process, the number of remaining available bits (abit') resulting from subtracting the number of bits to be allocated to all the units computed in the sample bit computing process from the total number of available bits is further allocated to several selected units, where 2 bits are allocated in the first pass to units whose SMR is larger than SMR-offset and to which no bits have been allocated at step S213, and an additional one bit is allocated in the second pass. Any of the number of remaining available bits (abit') is allocated to units u selected based on their negative flag (negflag[u]) setting. The presence of remaining available bits (abit') is due to the integer-truncation operation and the saturation of sample bits at a maximum limit of 16 bits occurring in the sample bit computing process. Two passes for the allocation of the remaining bits are employed, and in each pass the bit allocation of the number of remaining available bits (abit') starts from the highest frequency unit within the bandwidth computed at the steps S901 and S908, respectively. The first pass bit allocation is performed in the processes of steps S901 to S907, while the second pass bit allocation is performed in the processes of steps S908 to S914.

First of all, in the first pass of FIG. 16, the initial expected value of the unit u is set to the highest frequency unit within the computed bandwidth at step S901. Then at step S902, it is decided whether or not such an ending condition that u<0 is satisfied, where if the ending condition is satisfied, the program flow goes to step S908 to start the second pass process. On the other hand, if the ending condition is not satisfied, the program flow goes to step S903. At step S903, if such a condition that the negative flag (negflag[u]) is 2 is satisfied, the program flow goes to step S904, and otherwise, the program flow goes to step S907. Then at step S904, if such a condition that the number of remaining available bits (abit') is a double or more of the number of spectral lines (L[u]) in the unit u is satisfied, the program flow goes to step S905, and otherwise, the program flow goes to step S907. Further, the word length index (WLindex[u]) of the unit u is set to one at step S905, the number of remaining available bits (abit') is computed at step S906 by the following Equation (20), and the program flow goes to step S907. At step S907, the unit u is set by incrementing the unit by one, then the program flow returns to step S902:

$$abit' \leftarrow abit'-(2 \times L[u]) \quad (20).$$

That is, if the negative flag (negflag[u]) is two (where the number of bits allocated to the unit u is zero bit) and if the number of remaining available bits (abit') is greater than or equal to a double of the number of spectral lines (L[u]) in the unit u, then the number of bits equal to a double of the number of spectral lines (L[u]) is allocated to the unit u, while the number of remaining available bits (abit') is reduced by a double of the number of spectral lines (L[u]) in the unit u.

At step S907, the unit u is set by decrementing the unit by one, and the process of step S902 is redone. If the units to be processed have been processed, the program flow goes to step S908 of FIG. 17, which is the starting step of the second pass.

Then, in a manner similar to that of the first pass, at step S908 of the second pass, the unit u is set so as to starts from the highest frequency unit within the bandwidth. Then at step S909, it is decided whether or not such an ending condition that u<0 is satisfied. If the ending condition is satisfied, the remaining bit allocation process is completed, and then, as a result, the dynamic bit allocation process is completed. If the ending condition is not satisfied, the program flow goes to step S910. Then at step S910, if such a condition that the negative flag (negflag[u]) of the unit u is zero is satisfied, the program flow goes to step S911, and otherwise, the program flow goes to step S914. At step S911, if the number of available bits (abit) is equal to or greater than the number of spectral lines (L[u]) in the unit u, the program flow goes to step S912, and otherwise, the program flow goes to step S914. Further, the word length index (WLindex[u]) of the unit u is updated to a value obtained by adding one to the current word length index (WLindex[u]) at step S912, and then, the number of remaining available bits (abit') is updated at step S913 by the following Equation (21), then program flow goes to step S914:

$$abit' \leftarrow abit'-L[u] \quad (21).$$

At step S914, the unit u is set by incrementing the unit by one, the program flow then returns to step S909. That is, if the negative flag (negflag[u]) is zero (where the number of bits allocated to the unit u is 2 to 15 bits) and if the number of remaining available bits (abit') is greater than or equal to the number of spectral lines (L[u]) in the unit u, then a number of bits equal to the number of spectral lines is further allocated to the unit while the number of remaining available bits (abit') is reduced by the number of spectral lines (L[u]) in the unit u. In the way shown above, the remaining bits are allocated to the selected units.

As described above, the present preferred embodiment according to the present invention can be applied to almost all digital audio compression systems, and in particular, when used in the ATRAC algorithm, a speech having remarkably high audio quality can be generated while the bit allocation can be accomplished dynamically, remarkably effectively and efficiently. Further, the present bit allocation process has a relatively low implementation complexity as compared with that of the prior art, and low-cost LSI implementation of an audio encoder can be accomplished by using the ATRAC encoder 100 of the present preferred embodiment.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A dynamic bit allocation apparatus for audio coding for determining a number of bits used to quantize a plurality of decomposed samples of a digital audio signal, the plurality of samples being grouped into a plurality of units each having at least either one of different frequency intervals or time intervals, the different frequency intervals being determined based on a critical band of human audio characteristics, and the different time intervals including a first time interval and a second time interval longer than the first time interval, said apparatus comprising:

(a) absolute threshold setting means for setting an ib absolute threshold for every unit based on a specified threshold characteristic in quiet representing whether or not a person is audible in quiet;

(b) absolute threshold adjusting means for adjusting the absolute threshold of a unit having the first time interval by replacing the absolute threshold of the unit having the first time interval by a minimum absolute threshold among a plurality of units having the same frequency interval;

(c) peak energy computing means for computing peak energies of the units based on the plurality of samples grouped into the plurality of units;

(d) masking effect computing means for computing a masking effect that is a minimum audible limit with the simplified simultaneous masking effect model, based on a specified simplified simultaneous masking effect model and a peak energy of a masked unit when each of all the units has the second time interval, and updating and setting the absolute threshold of each unit with the computed masking effect;

(e) signal-to-mask ratio (SMR) computation means for computing SMRs of the units based on the computed peak energy of each unit and the computed absolute threshold of each unit;

(f) number-of-available-bits computing means for computing a number of bits available for bit allocation based on a frame size of the digital audio signal, assuming that all frequency bands to be quantized include all the units;

(g) SMR positive-conversion means for positively converting the SMRs of all the units by adding a specified positive number to the SMRs of all the SMRs so as to make the SMRs all positive;

(h) SMR-offset computing means for computing an SMR-offset which is defined as an offset for reducing the positively converted SMRs of all the units, based on the positively converted SMRs of all the units, a SMR reduction step determined based on an improvement in signal-to-noise ratio per bit of a specified linear quantizer, and the number of available bits;

(i) bandwidth computing means for updating a bandwidth which covers units that need to be allocated bits based on the computed SMR-offset and the computed SMRs of the units so as to update the SMR-offset based on the computed bandwidth;

(j) sample bit computing means for computing a subtracted SMR by subtracting the computed SMR-offset from the computed SMR in each unit, and then, computing a number of sample bits representing a number of bits to be allocated to each unit in quantization based on the subtracted SMR of each unit and the SMR reduction step; and (k) remaining bit allocation means for allocating a number of remaining bits resulting from subtracting a sum of the numbers of sample bits to be allocated to all the units from the computed number of available bits to at least units having an SMR larger than the SMR-offset.

2. The dynamic bit allocation apparatus for audio coding as claimed in claim 1, wherein said peak energy computing means computes the peak energy of each unit by executing a specified approximation in which an amplitude of the largest spectral coefficient within each unit is replaced by a scale factor corresponding to the amplitude with use of a specified scale factor table.

3. The dynamic bit allocation apparatus for audio coding as claimed in claim 1, wherein in a process by said masking effect computing means, the specified simplified simultaneous masking effect model includes a high-band side masking effect model to be used to mask an audio signal of units higher in frequency than the masked units, and a low-band side masking effect model lower in frequency than the masked units, and wherein said masking effect computing means sets an absolute threshold finally determined for each of the masked units to a maximum value out of the absolute thresholds of the masked units set by said absolute threshold setting means and a simultaneous masking effect determined by the simultaneous masking effect model.

4. The dynamic bit allocation apparatus for audio coding as claimed in claim 1, wherein said SMR computing means computes an SMR of each unit by subtracting the set absolute threshold from the peak energy of each unit in decibel (dB).

5. The dynamic bit allocation apparatus for audio coding as claimed in claim 1, wherein said SMR-offset computing means computes an SMR-offset by computing an initial SMR-offset based on the integer-truncated SMRs of all the units, the SMR reduction step and the number of bits available for the bit allocation, and then, performing a specified iterative process based on the computed initial SMR-offset.

6. The dynamic bit allocation apparatus for audio coding as claimed in claim 5, wherein said iterative process includes removing units each having an SMR smaller than the initial SMR-offset from the computation of the SMR-offset, and then, iteratively re-computing the SMR-offset based on the integer-truncated SMRs of the remaining units, the SMR reduction step and the number of available bits available for the bit allocation until SMRs of all the units involved in the SMR-offset computation become larger than the finally determined SMR-offset, thereby ensuring that there occurs no allocation of any negative bit number.

7. The dynamic bit allocation apparatus for audio coding as claimed in claim 1, wherein said bandwidth computing means computes the bandwidth by removing consecutive units from specified units when units having an SMR smaller than the SMR-offset are consecutively present, and wherein said bandwidth computing means adds the number of bits corresponding to the removed units to the number of available bits so as to update the number of available bits, and said updating of the SMR-offset is executed based on the updated number of available bits.

8. The dynamic bit allocation apparatus for audio coding as claimed in claim 1, wherein in the process performed by said sample bit computing means, the number of sample bits of each unit is a value which is obtained by subtracting the SMR-offset from the SMR of each unit, dividing the subtraction result by the SMR reduction step, and then, integer-truncating the division result, and wherein said sample bit computing means suppresses the bit allocation for units having an SMR smaller than the SMR-offset.

9. The dynamic bit allocation apparatus for audio coding as claimed in claim 1, wherein said remaining bit allocation means executes specified first and second pass processes for allocating the number of remaining bits, in the first pass process, one bit is allocated to units each of which has an SMR larger than the SMR-offset but to each of which no bits have been allocated as a result of integer-truncation in the process performed by said sample bit computing means, and in the second pass process, one bit is allocated to units to each of which a number of bits that is not the maximum number of bits but a plural number of bits has been allocated.

10. The dynamic bit allocation apparatus for audio coding as claimed in claim 9, wherein said remaining bit allocation means executes the first and second pass processes while the unit is transited from the highest frequency unit to the lowest frequency unit.

11. A dynamic bit allocation method for audio coding for determining a number of bits used to quantize a plurality of decomposed samples of a digital audio signal, the plurality of samples being grouped into a plurality of units each having at least either one of different frequency intervals or time intervals, the different frequency intervals being determined based on a critical band of human audio characteristics and the different time intervals including a first time interval and a second time interval longer than the first time interval, said method including the following steps of:

(a) an absolute threshold setting step for setting an absolute threshold for every unit based on a specified threshold characteristic in quiet representing whether or not a person is audible in quiet;

(b) an absolute threshold adjusting step for adjusting the absolute threshold of a unit having the first time interval by replacing the absolute threshold of the unit having the first time interval by a minimum absolute threshold among a plurality of units having the same frequency interval;

(c) a peak energy computing step for computing peak energies of the units based on the plurality of samples grouped into the plurality of units;

(d) a masking effect computing step for computing a masking effect that is a minimum audible limit with the simplified simultaneous masking effect model based on a specified simplified simultaneous masking effect model and a peak energy of a masked unit when all the units have the second time interval, and updating and setting the absolute threshold of each unit with the computed masking effect;

(e) a signal-to-maskratio (SMR) computation step for computing SMRs of the units based on the computed peak energy of each unit and the computed absolute threshold of each unit;

(f) a number-of-available-bits computing step for computing a number of bits available for bit allocation based on a frame size of the digital audio signal, assuming that all frequency bands to be quantized include all the units;

(g) an SMR positive-conversion step for positively converting the SMRs of all the units by adding a specified positive number to the SMRs of all the SMRs so as to make the SMRs all positive;

(h) an SMR-offset computing step for computing an SMR-offset which is defined as an offset for reducing the positively converted SMRs of all the units, based on the positively converted SMRs of all the units, a SMR reduction step determined based on an improvement in signal-to-noise ratio per bit of a specified linear quantizer, and the number of available bits;

(i) a bandwidth computing step for updating a bandwidth which covers units that need to be allocated bits based on the computed SMR-offset and the computed SMRs of the units so as to update the SMR-offset based on the computed bandwidth;

(j) a sample bit computing step for computing a subtracted SMR by subtracting the computed SMR-offset from the computed SMR in each unit, and then, computing a number of sample bits representing a number of bits to be allocated to each unit in quantization based on the subtracted SMR of each unit and the SMR reduction step; and (k) a remaining bit allocation step for allocating a number of remaining bits resulting from subtracting a sum of the numbers of sample bits to be allocated to all the units from the computed number of available bits to at least units having an SMR larger than the SMR-offset.

12. The dynamic bit allocation method for audio coding as claimed in claim 11, wherein in said peak energy computing step, the peak energy of each unit is computed by executing a specified approximation in which an amplitude of the largest spectral coefficient within each unit is replaced by a scale factor corresponding to the amplitude with use of a specified scale factor table.

13. The dynamic bit allocation method for audio coding as claimed in claim 11, wherein in said masking effect computing step, the specified simplified simultaneous masking effect model includes a high-band side masking effect model to be used to mask an audio signal of units higher in frequency than the masked units, and a low-band side masking effect model lower in frequency than the masked units, and wherein an absolute threshold finally determined for each of the masked units is set to a maximum value out of the set absolute thresholds of the masked units and the simultaneous masking effect determined by said simultaneous masking effect model.

14. The dynamic bit allocation method for audio coding as claimed in claim 11, wherein in said SMR computing step, the SMR of each unit is computed by subtracting the set absolute threshold from the peak energy of the unit in decibel (dB).

15. The dynamic bit allocation method for audio coding as claimed in claim 11, wherein in said SMR-offset computing step, the SMR-offset is computed by computing an initial SMR-offset based on the integer-truncated SMRs of all the units, the SMR reduction step and the number of bits available for the bit allocation, and then, performing a specified iterative process based on the computed initial SMR-offset.

16. The dynamic bit allocation method for audio coding as claimed in claim 15, wherein said iterative process includes the following steps of:

removing units having an SMR smaller than the initial SMR-offset from the computation of the SMR-offset; and iteratively re-computing the SMR-offset based on the integer-truncated SMRs of the remaining units, the SMR reduction step and the number of available bits available for the bit allocation until SMRs of all the units involved in the SMR-offset computation become larger than the finally determined SMR-offset, thereby ensuring that there occurs no allocation of any negative bit number.

17. The dynamic bit allocation method for audio coding as claimed in claim 11, wherein in said bandwidth computing step, the bandwidth is computed by removing consecutive units from specified units when units having an SMR smaller than the SMR-offset are consecutively present, and wherein the number of bits corresponding to the removed units is added to the number of available bits so as to update the number of available bits, said updating of the SMR-offset is executed based on the updated number of available bits.

18. The dynamic bit allocation method for audio coding as claimed in claim 11, wherein in said sample bit computing step, the number of sample bits of each unit is a value which is obtained by subtracting the SMR-offset from the SMR of each unit, dividing the subtraction result by the SMR reduction step, and then, integer-truncating the division result; and wherein the bit allocation for units having an SMR smaller than the SMR-offset is suppressed.

19. The dynamic bit allocation method for audio coding as claimed in claim 11, wherein in said remaining bit allocation step, specified first and second pass processes for allocating the number of remaining bits are executed;

in the first pass process, one bit is allocated to units each of which has an SMR larger than the SMR-offset but to each of which no bits have been allocated as a result of integer-truncation in said sample bit computing step; and in the second pass process, one bit is allocated to units to each of which a number of bits that is not the maximum number of bits but a plural number of bits has been allocated.

20. The dynamic bit allocation method for audio coding as claimed in claim 19, wherein in said remaining bit allocation step, the first and second pass processes are executed while the unit is transited from the highest frequency unit to the lowest frequency unit.

* * * * *

UNITED STATES PATENT AND TRADEMARK OFFICE

CERTIFICATE OF CORRECTION

PATENT NO. : 6,308,150 B1
DATED : October 23, 2001
INVENTOR(S) : S. H. Neo et al.

It is certified that error appears in the above-identified patent and that said Letters Patent is hereby corrected as shown below:

Column 21,
Line 8, after “an” delete “ib”.

Column 23,
Line 59, “signal-to-maskratio” should be -- signal-to-mask ratio --.

Signed and Sealed this

Fourth Day of June, 2002

*Attest:*

*Attesting Officer*

JAMES E. ROGAN
*Director of the United States Patent and Trademark Office*